US011965403B2

(12) United States Patent
Ben-Zvi et al.

(10) Patent No.: US 11,965,403 B2
(45) Date of Patent: Apr. 23, 2024

(54) GAS-PHASE SOLVENT MANAGEMENT DURING PRODUCTION OF IN-SITU HYDROCARBONS

(71) Applicant: Cenovus Energy Inc., Calgary (CA)

(72) Inventors: Amos Ben-Zvi, Calgary (CA); Amin Fardi, Calgary (CA); Simon D Gittins, Calgary (CA); Michael Miller, Calgary (CA); Ryan Miller, Calgary (CA); Trenton M Schrader, Calgary (CA)

(73) Assignee: Cenovus Energy Inc., Calgary (CA)

( * ) Notice: Subject to any disclaimer, the term of this patent is extended or adjusted under 35 U.S.C. 154(b) by 0 days.

(21) Appl. No.: 17/352,155

(22) Filed: Jun. 18, 2021

(65) Prior Publication Data

US 2021/0396110 A1 Dec. 23, 2021

Related U.S. Application Data

(60) Provisional application No. 63/040,946, filed on Jun. 18, 2020.

(51) Int. Cl.
*E21B 43/24* (2006.01)

(52) U.S. Cl.
CPC ..... *E21B 43/2408* (2013.01)

(58) Field of Classification Search
CPC ..... E21B 43/241; E21B 43/12; E21B 43/14; E21B 43/24–248; E21B 43/2408; E21B 43/16; E21B 43/166; E21B 43/168; E21B 47/06; E21B 47/07; E21B 34/06; E21B 34/08; E21B 34/16
See application file for complete search history.

(56) References Cited

U.S. PATENT DOCUMENTS

2011/0048707 A1* 3/2011 Kalman ..... E21B 43/16 166/279
2011/0186300 A1* 8/2011 Dykstra ..... F15C 1/16 138/40

(Continued)

FOREIGN PATENT DOCUMENTS

CA 2698898 A1 7/2011
CA 2757125 A1 2/2013

(Continued)

OTHER PUBLICATIONS

Gurgel et al. ("Reservoir and Operational Analysis for Steamflooding on Thin Oil Reservoirs"—Federal University of Rio Grande do Norte—SPE 122067—2009) (Year: 2009).*

*Primary Examiner* — George S Gray
(74) *Attorney, Agent, or Firm* — Gordon & Jacobson, P.C.

(57) ABSTRACT

Methods for producing hydrocarbons from subterranean reservoirs utilizing a production well having a plurality of fluid-inlet components spaced apart to define a plurality of production-well fluid-inlet zones. An injection fluid comprising a solvent is injected into the reservoir, resulting in a drainage fluid with a liquid phase and a gas phase occupying one or more of the production-well fluid-inflow zones. The production fluid is produced at a production-flow rate via a pump, and the gas phase:liquid phase ratio of the production fluid is modulated by orchestrating variations in the pump speed and one or more of the plurality of fluid-inlet components to prioritize hydraulic communication with a subset of the plurality of production-well fluid-inlet zones.

20 Claims, 22 Drawing Sheets

(56) References Cited

U.S. PATENT DOCUMENTS

| | | | | |
|---|---|---|---|---|
| 2015/0260027 | A1* | 9/2015 | Wang | E21B 43/2408 700/282 |
| 2015/0354330 | A1* | 12/2015 | Stahl | E21B 43/2406 166/272.3 |
| 2016/0170417 | A1* | 6/2016 | Sun, Jr. | E21B 47/06 700/282 |
| 2017/0058655 | A1* | 3/2017 | Lastiwka | E21B 43/12 |
| 2019/0120042 | A1* | 4/2019 | Doraiswamy | E21B 47/107 |
| 2019/0120043 | A1* | 4/2019 | Gupta | E21B 47/047 |
| 2020/0141209 | A1* | 5/2020 | Hogstead | E21B 41/00 |

FOREIGN PATENT DOCUMENTS

| | | | |
|---|---|---|---|
| CA | 2831928 | A1 | 5/2014 |
| CA | 2886934 | A1 | 9/2015 |

* cited by examiner

GAS-PHASE SOLVENT MANAGEMENT DURING PRODUCTION OF IN-SITU HYDROCARBONS

TECHNICAL FIELD

The present disclosure generally relates to methods for in-situ hydrocarbon production. In particular, the present disclosure relates to hydrocarbon-production processes that involve injecting solvent to mobilize viscous hydrocarbons.

BACKGROUND

Viscous hydrocarbons can be extracted from some subterranean reservoirs using in-situ production processes. Some in-situ production processes are thermal processes wherein heat energy is introduced to a reservoir to lower the viscosity of hydrocarbons in situ such that they can be recovered from a production well. In some thermal processes, heat energy is introduced by injecting a heated injection fluid into the reservoir by way of an injection well. Steam-assisted gravity drainage (SAGD) is a representative thermal-recovery process that uses steam to mobilize hydrocarbons in situ.

Some thermal recovery processes employ injection fluids that include solvent, optionally in combination with steam. Solvent-aided processes (SAP) are one such category. In the context of the present disclosure, SAP injection fluids comprise less than about 50% solvent and greater than about 50% steam on a mass basis. Solvent-driven processes (SDP) are another such category. In the context of the present disclosure, SDP injection fluids comprise greater than about 50% solvent and less than about 50% steam on a mass basis. SAP and/or SDP processes are typically employed as one phase in a broader production profile. For example, a well may be transitioned through: (i) a start-up phase during which hydraulic communication is established between an injection well and a production well; (ii) a SAGD phase during which a production chamber expands primarily in a vertical direction from the injection well and mobilized hydrocarbons are recovered from the production well along with condensed steam; (iii) an SAP and/or SDP phase during which injected solvent facilitates further chamber growth and hydrocarbon mobilization such that solvent and mobilized hydrocarbons are produced via the production well; and (iv) a blow-down phase during which non-condensable gas is injected to recover residual hydrocarbons and solvent that would otherwise remain stranded. In some cases, a well may be transitioned from a start-up phase to a SAP and/or SDP phase without an intervening SAGD phase.

Successfully executing the SAP and/or SDP phase(s) of a production process is difficult due at least in part to the inherent complexities associated with recovering production fluids that comprise both gas-phase and liquid-phase components. Under reservoir conditions, gas-phase solvents are often highly mobile, and can dominate flow paths into the production well. Conventional production-well completions are not well suited to managing both high gas-phase solvent ingress, and processes that use conventional production-well completions are often plagued by a lack of control over the gas phase:liquid phase ratio of the production fluid.

SUMMARY

During most SAP and/or SDP recovery phases, retaining gas-phase solvent within the reservoir during production is desirable. The reasons for this are at least twofold: firstly, produced gases require processing, and gas processing may create a bottleneck on oil production; secondly, in-situ gas-phase solvent in the reservoir can be used to drive further mobilization thereby improving recovery metrics. Accordingly, there is a need for alternative SAP and/or SDP strategies that allow for a greater degree of control over the extent to which gas-phase solvent is produced during SAP and/or SDP operation.

As set out in detail in the present disclosure, extensive field trials and state-of-the-art simulations indicate that, during a SAP and/or SDP, gas-phase solvent production can be modulated to provide improved recovery metrics by taking a coordinated approach to configuring and/or operating two production-well completions, the fluid-inlet components and the pump.

The present disclosure asserts that the pool of drainage fluids surrounding the production well can be segmented into semi-localized in-flow zones by spacing the fluid-inlet components at sufficient distances along the horizontal section of the production well. By employing fluid-inlet components that limit flow of high gas-content drainage fluids, the semi-localized zones that are occupied by high gas-content drainage fluids can be deprioritized in favour of those semi-localized zones occupied by low gas-content drainage fluids. As such, the produced fluids—those permitted within the production well—are better suited to the pump and facility thresholds, and the non-produced drainage fluids having high gas content are substantially retained within the reservoir.

It is reasonable to assume that using fluid-inlet components to limit the flow of high gas-content drainage fluids will result in a commensurate decrease in oil production. However, the results of the present disclosure indicate that this need not be the case. The methods of the present disclosure couple variations in the fluid-inlet configuration with pump-speed modulations, and the examples set out herein indicate that oil production rates can be maintained or even improved while simultaneously providing favourable liquid phase:gas phase ratios. Accordingly, the present disclosure provides a coordinated approach to configuring and/or operating the production well to provide alternative SAP and/or SDP strategies that allow for a greater degree of control over the extent to which gas-phase solvent is produced during SAP and/or SDP operation. For example, a threshold gas-production rate may be selected, and a method in accordance with the present disclosure may be implemented to achieve a target oil-production rate without violating the threshold. Likewise, a threshold oil-production rate may be selected, and a method in accordance with the present disclosure may be implemented to maintain gas production below a threshold gas-production rate.

Select embodiments of the present disclosure relate to a method for producing hydrocarbons from a subterranean reservoir that is penetrated by an injection well and a production well. The production well comprises a substantially-horizontal section along which a plurality of fluid-inlet components are spaced apart to define a plurality of production-well fluid-inlet zones. At least one of the production-well fluid-inlet zones is in hydraulic communication with the horizontal section of the production well. The method comprises injecting an injection fluid comprising a solvent into the reservoir, by way of the injection well, to mobilize hydrocarbons in the reservoir, such that a drainage fluid comprising a liquid phase and a gas phase occupies one or more of the production-well fluid-inlet zones. The gas phase comprises at least a portion of the solvent and the liquid phase comprises at least mobilized hydrocarbons. The method further comprises producing a production fluid at a production-flow rate via a pump running at a pump speed and in hydraulic communication with the production fluid. The production fluid comprises at least a portion of the liquid phase of the drainage fluid and at least a portion of the gas phase of the drainage fluid such that the production fluid is defined by a liquid phase:gas phase ratio. The method further comprises: (i) orchestrating variations in one or more of the plurality of fluid-inlet components to modulate the liquid phase:gas phase ratio of the production fluid by prioritizing hydraulic communication with a subset of the plurality of production-well fluid-inflow zones, and (ii) orchestrating variations in the pump speed to modulate the production-flow rate and account for the variations in one or more of the plurality of fluid-inlet components.

Other aspects and features of the methods of the present disclosure will become apparent to those ordinarily skilled in the art upon review of the following description of specific embodiments.

BRIEF DESCRIPTION OF THE DRAWINGS

These and other features of the present disclosure will become more apparent in the following detailed description in which reference is made to the appended drawings. The appended drawings illustrate one or more embodiments of the present disclosure by way of example only and are not to be construed as limiting the scope of the present disclosure.

DETAILED DESCRIPTION

Figure 1:
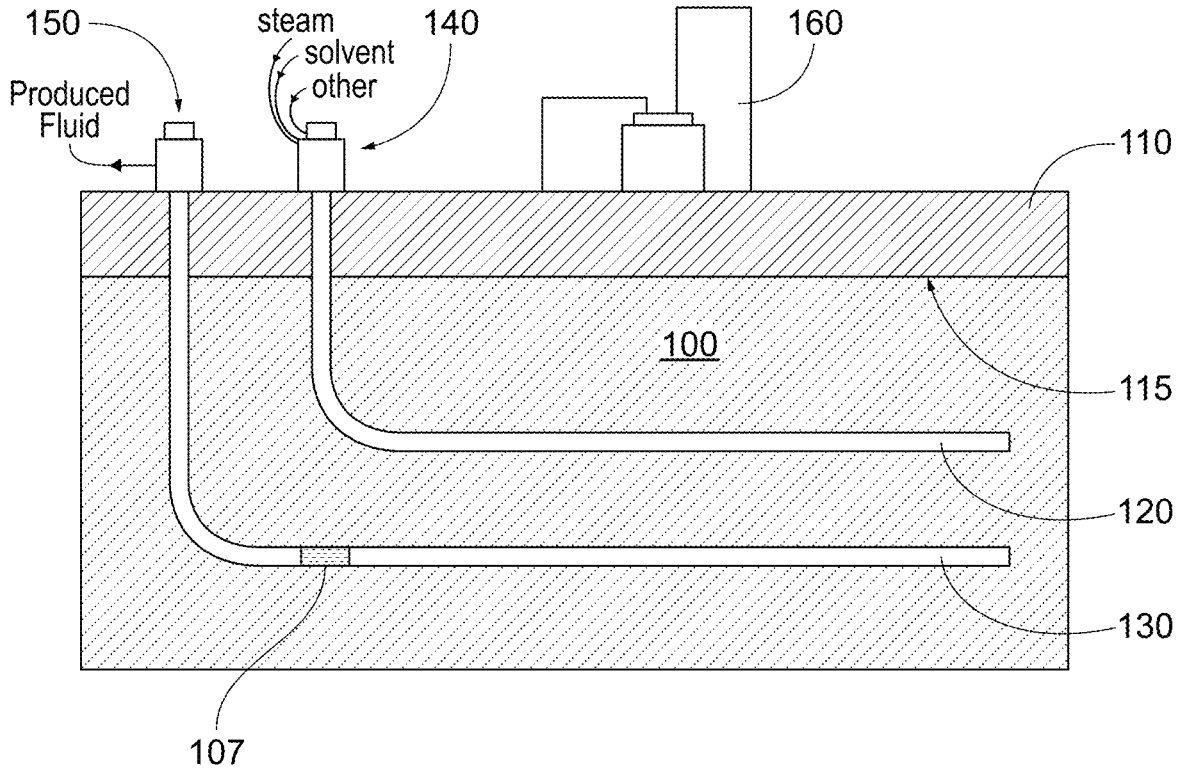
FIG. 1 shows a schematic illustration of a typical well pair configuration in a hydrocarbon reservoir, which are operable to implement an embodiment of the present disclosure.

During operation of solvent-aided processes (SAP) and or solvent-driven processes (SDP), inefficiencies can arise by solvent short-circuiting from the injection well or production chamber to the horizontal production well. This can cause preferential flow of solvent vapor rather than oil/water/emulsion and lead to inefficient operations where more solvent vapor is removed than desired. The present disclosure reports a coordinated approach to configuring and/or operating the production well so as to provide a greater degree of control over the extent to which gas-phase solvent is produced during SAP and/or SDP operation. By employing fluid-inlet components that limit flow of high gas-content drainage fluids, the pool of drainage fluids surrounding the production well can be segmented into semi-localized in-flow zones, such that solvent short-circuiting can be mitigated. The semi-localized zones that are occupied by high-gas content drainage fluids can be deprioritized in favour of those semi-localized zones occupied by low gas-content drainage fluids. The present disclosure reports that modulating pump speed has a considerable impact on the cumulative flow through the flow-inlet components, such that oil production can actually be increased while maintaining solvent ingress below threshold levels. For example, the simulations set out herein indicate anticipated improvements in oil rates, gas rates, steam-oil ratios, solvent-oil ratios, and oil-recovery factors.

In the context of the present disclosure, fluid-inlet components at the production well may include any type of component that prioritizes liquid flow over gas flow, such as inflow control devices (ICDs) and/or upper production ports (UPP). At a high level, ICDs/UPPs may use one or more restrictions to reduce flow and create pressure drop across the components. Higher pressure drops will be created as a result of higher flow rates (typically gas) which in turn, chokes off the production through that component. There are two main types of components: ones that are sensitive to fluid viscosity and ones that are sensitive to fluid density. Components that are sensitive to viscosity are typically long, narrow channels (helical shaped or long tubes) which are dominated by shear at the wall/fluid interface. components that use fluid density and flow rate to achieve a pressure drop, require restrictive ports (e.g. orifices or nozzles). ICDs are more sophisticated components with multiple configurations/designs and range from elongated nozzles, to complex tortuous path designs. UPPs, on the other hand, are very simple designs which incorporate holes drilled into tubing that are appropriately sized. Both ICDs and UPPs may be implemented in the methods of the present disclosure, as set out below.

In the context of the present disclosure, ICDs may comprise shiftable ports that can be closed remotely using coiled tubing or other means of actuation. The ports in any particular compartment can then be closed when high gas flows are detected based on distributed acoustic sensing (DAS) and/or distributed temperature sensing (DTS) for instance or can be closed at predetermined times based on well trajectories and times when gas flow at particular locations are expected to become problematic such as high spots in the production well or sections where there are nearby production wells at lower elevations. Alternatively, ICDs may be autonomous inflow control devices/valves (AICD/AICV) which can close or restrict flow based on the nature of the fluid flowing. Autonomous valves may be designed to restrict or shut off flow whenever gas production reached a threshold level and so could automatically limit gas flow from any compartment of the well pair where gas volumes became problematic. Under reservoir conditions, gas tends to flow with significantly less resistance than oil, water, or emulsion, for example because of the high relative permeability and the low dynamic viscosities characteristic of reservoir gases. When gas flows into a production well at a particular location then it can limit the ability to produce oil and water from other locations along the same production well (as by applying more drawdown/pressure drop more gas is pulled into the production well at that location preferentially to liquids from other locations). By compartmentalizing the well (preventing/restricting flow along the annulus between the tubing and the liner) and shutting off or restricting flow from the liner to the tubing in the compartments where high gas-concentration fluids are entering the liner, then more drawdown/pressure drop can be applied and will pull in more fluid from the segments occupied by low gas-concentration fluids.

In select embodiments of the present disclosure, the ICDs may be coupled to the liner so that gas-phase flow into the liner is controlled. In such embodiments, a production-tubing string may not be required in the horizontal section of the production well.

In select embodiments of the present disclosure, the ICDs may be coupled to a production-tubing string within the production well. With this configuration, fluids inside the production-tubing string may be in hydraulic communication with the pump inlet. In such embodiments, communication between ICDs on the outside of the tubing may be restricted by annulus-flow restrictors.

In the context of the present disclosure, annulus-flow restrictors are used to restrict the movement of gases along the annular space into the next port or device. Without such restriction, gases that fail to pass into the production-tubing string at one location may flow along the annulus to another inlet point, and this may compromise the isolation of the plurality of production-well fluid-inlet zones. In select embodiments of the present disclosure, one or more of the annulus-flow restrictors may be reduced flow areas created by physical restriction or by pressure gradients resulting from flow or gravity based on the configuration of the tubing and the location of the devices. Depending on the configuration of the production well, pressure gradients from excess gas flowing along the annular space to the next point of entry may be enough to limit how much of the gas is able to flow along the annulus and in through the adjacent ICD—especially If the ICDs are spaced well apart and/or the annular space is small due to large production tubing (or coupling) outer diameter relative to the liner inner diameter.

In select embodiments, one or more of the annulus-flow restrictors may comprise one or more packers. As will be appreciated by those skilled in the art who have benefitted from the teachings of the present disclosure, while packers may take a variety of forms, they are typically designed to segregate flow within the annulus.

Select embodiments of the present disclosure relate to a method for producing hydrocarbons from a subterranean reservoir that is penetrated by an injection well and a production well. The production well comprises a substantially-horizontal section along which a plurality of fluid-inlet components that are spaced apart to define a plurality of production-well fluid-inlet zones. At least one of the production-well fluid-inlet zones is in hydraulic communication with the horizontal section of the production well. The method comprises injecting an injection fluid comprising a solvent into the reservoir, by way of the injection well, to mobilize hydrocarbons in the reservoir, such that a drainage fluid comprising a liquid phase and a gas phase occupies one or more of the production-well fluid-inlet zones. The gas phase comprises at least a portion of the solvent and the liquid phase comprises mobilized hydrocarbons. The method further comprises producing a production fluid at a production-flow rate via a pump running at a pump speed and in hydraulic communication with the production fluid. The production fluid comprises at least a portion of the liquid phase of the drainage fluid and at least a portion of the gas phase of the drainage fluid such that the production fluid is defined by a liquid phase:gas phase ratio. The method further comprises: (i) orchestrating variations in one or more of the plurality of fluid-inlet components to modulate the liquid phase:gas phase ratio of the production fluid by prioritizing hydraulic communication with a subset of the plurality of production-well fluid-inflow zones, and (ii) orchestrating variations in the pump speed to modulate the production-flow rate and account for the variations in one or more of the plurality of fluid-inlet components In select embodiments of the present disclosure, the plurality of fluid-inlet components comprises one or more inflow-control devices. In select embodiments of the present disclosure, the one or more inflow-control devices comprise shiftable ports that are configured for remote operation. In select embodiments of the present disclosure, the shiftable ports are actuated in response to changes in distributed acoustic sensing (DAS) and/or distributed temperature sensing (DTS). In select embodiments of the present disclosure, the shiftable ports are actuated in response to changes in the liquid phase:gas phase ratio of the production fluid.

In select embodiments of the present disclosure, the one or more inflow-control devices are autonomous inflow-control devices.

In select embodiments of the present disclosure, the plurality of fluid-inlet components comprises one or more upper production ports.

In select embodiments of the present disclosure, the plurality of fluid-inlet components are spaced along the substantially-horizontal section of the production well to define between about two and about eight production-well fluid-inlet zones. For example, the substantially-horizontal section of the production well may be about 1,000 m, and the fluid-inlet components may be spaced apart by about 50 m to about 500 m. In select embodiments, the fluid-inlet components may be spaced apart at substantially equal distances, or the fluid-inlet components may be spaced apart at non-equal distances (such as to account for changes in reservoir geology and/or well trajectory).

In select embodiments of the present disclosure, one or more of the fluid-inlet components are interposed between annulus-flow restrictors. In select embodiments of the present disclosure, the annulus-flow restrictors comprise packers.

In select embodiments of the present disclosure, orchestrating variations in the pump speed comprises adjusting parameters such that the average gas-production rate is between: (i) about 1,000 $m^3$/day and about 30,000 $m^3$/day under STP conditions, (ii) about 10,000 $m^3$/day and about 30,000 $m^3$/day under STP conditions, or (iii) about 20,000 $m^3$/day and about 30,000 $m^3$/day under STP conditions. Those skilled in the art who have benefitted from the teachings of the present disclosure will appreciate that target gas-production rates may be adjusted in response to a variety of factors such as gas-treatment capacity and/or gas-production rates from adjacent well pairs. In the context of the present disclosure, there is also scope to change the pumping system design to allow better gas separation which may accommodate higher gas-production rates (with commensurate increases in oil/emulsion production) by avoiding a surface limitation. For example, improved phase separation at the pump may increase the fraction of gas flow up the casing, where there may be fewer limitations relative to gas that is produced via the production string.

In select embodiments of the present disclosure, the liquid phase:gas phase ratio of the production fluid is between: (i) about 1:100 and about 1:1, (ii) about 1:80 and about 1:20, or (iii) about 1:60 and about 1:40.

In select embodiments of the present disclosure, at least one of the plurality of production-well fluid-inlet zones has a temperature of between: (i) about 50° C. and about 300° C., (ii) about 70° C. and about 250° C., or (iii) about 120° C. and about 200° C.

In select embodiments of the present disclosure, at least one of the plurality of production-well fluid-inlet zones has a pressure of between: (i) about 500 kPaA and about 10,000 kPaA, (ii) about 1,000 kPaA and about 8,000 kPaA, or (iii) about 3,000 kPaA and about 6,000 kPaA.

In select embodiments of the present disclosure, the injection fluid further comprises steam. In select embodiments of the present disclosure, the injection fluid comprises less than about 50% solvent and greater than about 50% steam on a mass basis. In select embodiments of the present disclosure, the injection fluid comprises greater than about 50% solvent and less than about 50% steam on a mass basis.

In select embodiments of the present disclosure, the solvent comprises propane, butane, diluent, natural gas condensate, or a combination thereof.

In select embodiments of the present disclosure, the subterranean reservoir is a thin pay reservoir having an average height of between about 5 m and about 15 m.

Embodiments of the present disclosure will now be described by reference to FIG. 1 to FIG. 14C.

FIG. 1 schematically illustrates a typical well pair configuration in a hydrocarbon reservoir 100, which can be operated to implement an embodiment of the present disclosure. The well pair may be configured and arranged similar to a typical well pair configuration for SAGD operations.

As illustrated, the reservoir 100 contains heavy hydrocarbons below an overburden 110. Under natural conditions before any treatment, reservoir 100 is at a relatively low temperature, such as about 12° C., and the reservoir pressure may be from about 0.1 MPa to about 4 MPa, depending on the location and other characteristics of the reservoir.

The well pair includes an injection well 120 and a production well 130, which have horizontal sections extending substantially horizontally in reservoir 100, and which are drilled and completed for injecting injection fluids and producing hydrocarbons from reservoir 100. As depicted in FIG. 1, the well pair is typically positioned away from the overburden 110 and near the bottom of the pay zone or geological stratum in reservoir 100, as can be appreciated by those skilled in the art.

As is typical, injection well 120 may be vertically spaced from production well 130, such as at a distance of about 3 m to about 8 m, e.g., 5 m. The distance between the injection well and the production well may vary and may be selected to optimize the operation performance within technical and economical constraints, as can be understood by those skilled in the art. In select embodiments of the present disclosure, the horizontal sections of wells 120 and 130 may have a length of about 800 m. In other embodiments, the length may be varied as can be understood and selected by those skilled in the art. Wells 120 and 130 may be configured and completed according to any suitable techniques for configuring and completing horizontal in situ wells known to those skilled in the art. Injection well 120 and production well 130 may also be referred to as the "injection well" and "production well", respectively.

The overburden 110 may be a cap layer or cap rock. Overburden 110 may be formed of a layer of impermeable material such as clay or shale. A region in the reservoir 100 just below and near overburden 110 may be considered as an interface region 115.

As illustrated, wells 120 and 130 are connected to respective corresponding surface facilities, which typically include an injection surface facility 140 and a production surface facility 150. Surface facility 140 is configured and operated to supply injection fluids, such as steam and solvent, into injection well 120. Surface facility 150 is configured and operated to produce fluids collected in production well 130 to the surface. Each of surface facilities 140, 150 includes one or more fluid pipes or tubing for fluid communication with the respective well 120 or 130. As depicted for illustration, surface facility 140 may have a supply line connected to a steam generation plant for supplying steam for injection, and a supply connected to a solvent source for supplying the solvent for injection. Optionally, one or more additional supply lines may be provided for supplying other fluids, additives or the like for co-injection with steam or the solvent. Each supply line may be connected to an appropriate source of supply (not shown), which may include, for example, a steam generation plant, a boiler, a fluid mixing plant, a fluid treatment plant, a truck, a fluid tank, or the like. In select embodiments of the present disclosure, co-injected fluids or materials may be pre-mixed before injection. In other embodiments, co-injected fluids may be separately supplied into injection well 120. In particular, surface facility 140 is used to supply steam and a selected solvent into injection well 120. The solvent may be pre-mixed with steam at surface before co-injection. Alternatively, the solvent and steam may be separately fed into injection well 120 for injection into formation 100. Optionally, surface facility 140 may include a heating facility (not separately shown) for pre-heating the solvent before injection.

As illustrated, surface facility 150 includes a fluid transport pipeline for conveying produced fluids to a downstream facility (not shown) for processing or treatment. Surface facility 150 includes necessary and optional equipment for producing fluids from production well 130, as can be understood by those skilled in the art. An embodiment of surface facility 150 includes one or more valves for regulating the fluid flow in the liquid line of the produced fluid. The valve(s) may be a choke valve, such as an inline globe valve. The valve may be selected and configured to control the "backpressure" and the flow rate in the liquid line (also referred to as the emulsion line in the art).

Other necessary or optional surface facilities 160 may also be provided, as can be understood by those skilled in the art. For example, surface facilities 160 may include one or more of a pre-injection treatment facility for treating a material to be injected into the formation, a post-production treatment facility for treating a produced material, a control or data processing system for controlling the production operation or for processing collected operational data. Surface facilities 140, 150 and 160 may also include recycling facilities for separating, treating, and heating various fluid components from a recovered or produced reservoir fluid. For example, the recycling facilities may include facilities for recycling water and solvents from produced reservoir fluids.

Injection well 120 and production well 130 may be configured and completed in any suitable manner as can be understood or is known to those skilled in the art, so long as the wells are compatible with injection and recovery of heavy hydrocarbons. For example, in different embodiments, the well completions may include perforations, slotted liner, screens, and/or outflow control devices such as in injection well 120. For simplicity, other necessary or optional components, tools or equipment that are installed in the wells are not shown in the drawings as they are not particularly relevant to the present disclosure.

Figure 2:
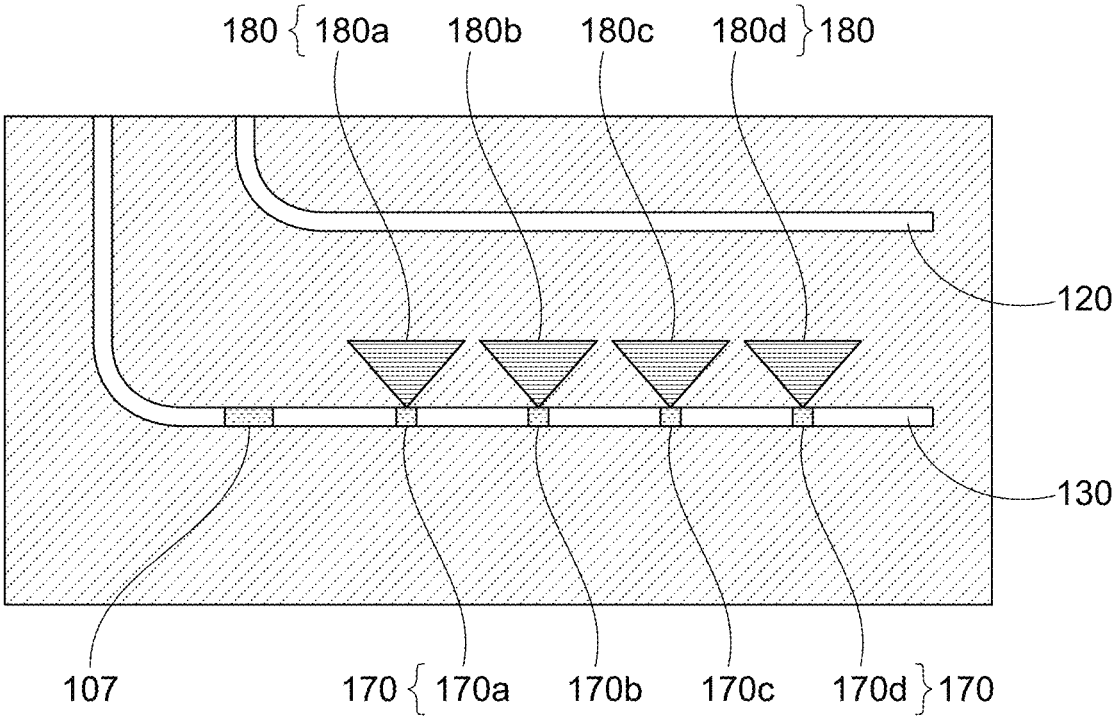
FIG. 2 shows an expansion of the schematic of FIG. 1, with additional details provided with respect to the production well.

FIG. 2 shows an expansion of the schematic of FIG. 1, with additional details provided with respect to production well 130. In, FIG. 2, production well 130 comprises a pump 107 for producing fluids to facility 150. Production well 130 further comprises a plurality of flow-inlet components 170. Individual flow-inlet components 170*a*, 170*b*, 170*c*, and 170*d* are referenced in FIG. 2 as units in the plurality of flow-inlet components 170, and they are spaced apart along the horizontal section of production well 130. In select embodiments of the present disclosure, individual flow-inlet components may be interposed between annulus-flow restrictors (e.g. packers). The plurality of inflow control devices are configured to uptake produced fluid into production well 130, and at least one of the plurality of inflow control devices is in hydraulic communication with the reservoir 100. In particular, injection fluid and mobilized hydrocarbons may collect as drainage fluids in proximity to the production well 130. Hydraulic communication between collections of drainage fluids and the plurality of flow-inlet components 170 results in a plurality of production-well fluid-inlet zones 180. Individual production-well fluid-inlet zones 180*a*, 180*b*, 180*c*, and 180*d* are referenced in FIG. 2 as discrete components of the plurality of production-well fluid-inlet zones 180, however, two or more production-well fluid-inflow zones may be in hydraulic communication with each other. Nonetheless, as set out in detail below, the drainage fluids occupying adjacent production-well fluid-inflow zones may have different gas phase:liquid phase ratios, such that reducing flow through one or more of the plurality of fluid-inlet components 170 while simultaneous operating pump 107 to move produced fluids towards surface facility 150 may result in improved production metrics. Accordingly, in the context of the present disclosure, the plurality of production-well fluid-inlet zones 180 may be considered to be semi-localized.

The methods of the present disclosure may be executed as part of a broader production lifecycle comprising a start-up phase, a ramp-up phase, a production phase, and a wind-down/blowdown phase. In an exemplary start-up phase, fluid communication between wells 120 and 130 is established in a manner that may be similar to the initial start-up phase in a conventional SAGD process. To permit drainage of mobilized hydrocarbons and condensate to production well 130, fluid communication between wells 120, 130 must be established. Fluid communication refers to fluid flow between the injection and production wells. Establishment of such fluid communication typically involves mobilizing viscous hydrocarbons in the reservoir to form a drainage fluid and removing the drainage fluid to create a porous pathway between the wells. In the context of the present disclosure, a drainage fluid may comprise a liquid phase and a gas phase, and the liquid phase may comprise mobilized hydrocarbons. To form a drainage fluid, viscous hydrocarbons may be mobilized by heating such as by injecting or circulating pressurized steam or hot water through injection well 120 or production well 130. In some cases, steam may be injected into, or circulated in, both injection well 120 and production well 130 for faster start-up. A pressure differential may be applied between injection well 120 and production well 130 to promote steam/hot water penetration into the porous reservoir area that lies between the wells of the well pair. The pressure differential may promote fluid flow and convective heat transfer to facilitate communication between the wells.

As is typical, the injection and production wells 120, 130 have terminal sections that are substantially horizontal and substantially parallel to one another. A person of skill in the art will appreciate that while there may be some variation in the vertical or lateral trajectory of the injection or production wells, causing increased or decreased separation between the wells, such wells for the purpose of this application will still be considered substantially horizontal and substantially parallel to one another. Spacing, both vertical and lateral, between injection wells and production wells may be optimized for establishing start-up or based on reservoir conditions.

Additionally or alternatively, other techniques may be employed during the start-up phase. For example, to facilitate fluid communication, a solvent may be injected into the reservoir region around and between the injection and production wells 120, 130. The region may be soaked with a solvent before or after steam injection. An example of start-up using solvent injection is disclosed in CA 2,698,898. In further examples, the start-up phase may include one or more start-up processes or techniques disclosed in CA 2,886,934, CA 2,757,125, or CA 2,831,928.

Once fluid communication between injection well 120 and production well 130 has been achieved, oil production or recovery may commence. As the oil production rate is typically low initially and will increase as the production chamber develops, the early production phase is known as the "ramp-up" phase. During the ramp-up phase, steam, with or without a solvent, is typically injected continuously into injection well 120, at constant or varying injection pressure and temperature. At the same time, drainage fluids comprising mobilized heavy hydrocarbons and aqueous condensate are continuously removed from production well 130. During ramp-up, the zone of communication between injection well 120 and production well 130 may continue to expand axially along the full length of the horizontal portions of wells 120, 130.

As the injected fluid heats up reservoir 100, heavy hydrocarbons in the heated region are softened, resulting in reduced viscosity. Further, as heat is transferred from steam to reservoir 100, steam and solvent vapour condense. The aqueous and solvent condensate and mobilized hydrocarbons will drain downward due to gravity. As a result of depletion of the heavy hydrocarbons, a porous region is formed in reservoir 100, which is referred to herein as a "production chamber". When a production chamber is filled with mainly steam, it is commonly referred to in the art as a "steam chamber." As the drainage fluids drain towards production well 130, they are taken up into production well 130 via one or more of the plurality of flow-inlet components 170. As discussed in detail below, individual flow-inlet components may be configured to choke-off gas ingress, such that the plurality flow-inlet components—taken together—serve to prioritize emulsion flow into the production well 130. As such, the drainage fluids collecting in proximity to the production well 130 are likely to be characterized by higher gas:liquid ratios than the production fluids inside the production well 130. Accordingly, in the context of the present disclosure, production fluids and drainage fluids are not used interchangeably. In the context of the present disclosure, production fluids are those which are transferred to the surface, such as by gas lifting or through pumping with a pump 107 as is known to those skilled in the art.

At the point of injection into the reservoir 100, or in the injection well 120, the injected fluid/mixture may be at a temperature that is selected to optimize the production performance and efficiency. For example, for a given solvent to be injected the injection temperature may be selected based on the boiling point (or saturation) temperature of the solvent at the expected operating pressure in the reservoir. For propane, the boiling temperature is about 2° C. at about 0.5 MPa, and about 77° C. at about 3 MPa. For a different solvent, the injection temperature may be higher if the boiling point temperature of that solvent at the reservoir pressure is higher. In different embodiments and applications, the injection temperature may be substantially higher than the boiling point temperature of the solvent by, e.g., about 5° C. to about 200° C., depending on various operation and performance considerations. In some embodiments, the injection temperature may be from about 50° C. to about 320° C., and at a pressure from about 0.5 MPa to about 12.5 MPa, such as from about 0.6 MPa to about 5.1 MPa or up to about 10 MPa. At an injection pressure of about 3 MPa, the injection temperature for propane may be from about 80° C. to about 250° C., and the injection temperature for butane may be from about 100° C. to about 300° C. The injection temperature and pressure are referred to as injection conditions. A person skilled in the art will appreciate that the injection conditions may vary in different embodiments depending on, for example, the type of hydrocarbon recovery process implemented or the mobilizing agents selected, as well as various factors and considerations for balancing and optimizing production performance and efficiency. The injection temperature should not be too high as a higher injection temperature will typically require more heating energy to heat the injected fluid. Further, the injection temperature should be limited to avoid coking hydrocarbons in the reservoir formation. In some oil sands reservoirs, the coking temperature of the bitumen in the reservoir is about 350° C.

Once injected steam and vapour of the injected solvent enter the reservoir, their temperature may drop under the reservoir conditions. The temperatures at different locations in the reservoir will vary as typically regions further away from injection well 120, or at the edges of the production chamber, are colder. During operations, the reservoir conditions may also vary. For example, the reservoir temperatures can vary from about 10° C. to about 275° C., and the reservoir pressures can vary from about 0.6 MPa to about 7 MPa depending on the stage of operation. The reservoir conditions may also vary in different embodiments. As noted above, injected steam and solvent condense in the reservoir mostly at regions where the reservoir temperature is lower than the dew point temperature of the solvent at the reservoir pressure. Condensed steam (water) and solvent can mix with the mobilized bitumen to form drainage fluids. It is expected that in a typical reservoir subjected to steam/solvent injection, the drainage fluids include a stream of condensed steam (or water, referred to as the water stream herein). The water stream may flow at a faster rate (referred to as the water flow rate herein) than a stream of mobilized bitumen containing oil (referred to as the oil stream herein), which may flow at a slower rate (referred to as the oil flow rate herein). The drainage fluids can be drained to the production well by gravity. The mobilized bitumen may still be substantially more viscous than water, and may drain at a relatively low rate if only steam is injected into the reservoir. However, condensed solvent may dilute the mobilized bitumen and increase the flow rate of the oil stream.

Thus, injected steam and vapour of the solvent both assist to mobilize the viscous hydrocarbons in the reservoir 100. A drainage fluid formed in the production chamber may include oil, condensed steam (water), and a condensed phase of the solvent. The reservoir fluid is drained by gravity along the edge of production chamber into production well 130 for recovery of oil.

In various embodiments, the solvent may be selected so that dispersion of the solvent in the production chamber, as well as in the drainage fluid increases the amount of oil contained in the fluid and increases the flow rate of oil stream from production chamber to the production well 130. When solvent condenses (forming a liquid phase) in the production chamber, it can be dispersed in the drainage fluid to increase the rate of drainage of the oil stream from the reservoir 100 into the production well 130.

After the produced fluids are surfaced, the solvent and water may be separated from oil in the produced fluids by a method known in the art depending on the particular solvent (s) involved. The separated water and solvent can be further processed by known methods, and recycled to the injection well 120. In some embodiments, the solvent is also separated from the produced water before further treatment, re-injection into the reservoir, or disposal.

As mentioned above, the production chamber forms and expands due to depletion of hydrocarbons and other in situ materials from regions of reservoir 100 above the injection well 120. Injected steam/solvent vapour tend to rise up to reach the top of production chamber before they condense, and steam/solvent vapour can also spread laterally as they travel upward. During early stages of chamber development, the production chamber expands upwardly and laterally from injection well 120. During the ramp-up phase and the early production phase, the production chamber can grow vertically towards overburden 110. At later phases, after the production chamber has reached the overburden 110, the production chamber may expand mainly laterally. Depending on the size of reservoir 100 and the pay therein and the distance between injection well 120 and overburden 110, it can take a long time, such as many months and up to two years, for the production chamber to reach overburden 110, when the pay zone is relative thick as is typically found in some operating oil sands reservoirs. However, it will be appreciated that in a thinner pay zone, the production chamber can reach the overburden sooner. The time to reach the vertical expansion limit can also be longer in cases where the pay zone is higher or highly heterogeneous, or the formation has complex overburden geologies such as with inclined heterolithic stratification (HIS), top water, top gas, or the like.

In some embodiments of the present disclosure, at early stages of oil production, steam may be injected without a solvent. The solvent may be added as a mobilizing agent after the production chamber has reached or is near the top of the pay zone, e.g., near or at the lower edge of the overburden 110 or after the oil production rate has peaked. The solvent can dissolve in oil and dilute the oil stream so as to increase the mobility and flow rate of hydrocarbons or the diluted oil stream towards production well 130 for improved oil recovery. Other materials in liquid or gas form may also be added to the injection fluid to enhance recovery performance.

The start-up, ramp-up, and production phases may be conducted according to any suitable conventional techniques known to those skilled in the art except the aspects described herein, and the other aspects will therefore not be detailed herein for brevity. As an example, during production, such as at the end of an initial production period with steam injection, the formation temperature in the production chamber can reach about 235° C. and the pressure in the production chamber may be about 3 MPa. The temperature or pressure may vary by about 10% to about 20%.

As mentioned earlier, in a particular embodiment where propane is used as the solvent, the injection temperature of the steam-propane mixture may be about 80° C. to about 250° C. In other embodiments, the injection temperature may be selected based on the boiling point temperature of the solvent at the selected injection pressure. Of course, depending on the reservoir and the application, the chamber temperature and pressure may also vary in different embodiments. For example, in various embodiments, steam may be injected at a temperature from about 150° C. to about 330° C. and a pressure from about 0.1 MPa to about 12.5 MPa. In some embodiments, the highest temperature in the production chamber may be from about 50° C. to about 350° C. and the pressure in the production chamber may be from about 0.1 MPa to about 7 MPa.

In further embodiments, it may also be possible that steam is injected at a temperature sufficient to heat the solvent such that the injected solvent has a maximum temperature of between about 50° C. and about 350° C. within the production chamber.

A suitable solvent may be selected based on a number of considerations and factors as discussed herein. The solvent should be injectable as a vapour, and can dissolve at least one of the heavy hydrocarbons to be recovered from reservoir 100 in the solvent-steam process for increasing mobility of the heavy hydrocarbons. The solvent may be a viscosity-reducing solvent, which reduces the viscosity of the heavy hydrocarbons in reservoir 100.

It is noted that steam injection with solvent injection can conveniently facilitate transportation of the solvent as a vapour with steam to the steam front. Steam is typically a more efficient heat-transfer medium than a solvent, and can increase the reservoir temperature more efficiently and more economically, or maintain the production chamber at a higher temperature. The heat, or higher formation temperature in a large region in the formation, can help to maintain the solvent in the vapour phase and assist dispersion of the solvent to the chamber edges ("steam front"). The heat from steam can also by itself assist reduction of viscosity of the hydrocarbons. However, injecting steam requires more heating energy and inject steam at a too high ratio can reduce the energy efficiency of the process.

The solvent is injected into reservoir 100 in a vapour phase. Injection of the solvent in a vapour phase allows the solvent vapour to travel in the production chamber and condense at a region away from injection well 120. Allowing solvent to travel in production chamber before condensing may achieve beneficial effects. For example, oil production performance, such as indicated by one or more of oil production rate, cumulative steam to oil ratio (cSOR), and overall efficiency, may be improved. Injection of solvent in the gaseous phase, rather than a liquid phase, may allow vapour to rise in production chamber before condensing so that condensation occurs away from injection well 120. It is noted that injecting solvent vapour into the production chamber does not necessarily require solvent be fed into the injection well in vapour form. The solvent may be heated downhole and vaporized in the injection well 120 in some embodiments. Alternatively, the solvent may be injected into another well or other wells for more efficient delivery of the solvent to desired locations in the reservoir. The additional well(s) may include a vertical well, a horizontal well, or a well drilled according to the well drilled using Wedge Well™ technology.

The total injection pressure for solvent and steam co-injection may be the same or different than the injection pressure during a conventional SDP production process. For example, the injection pressure may be maintained at between about 2 MPa and about 3.5 MPa, or up to about 4 MPa. In another example, steam may be injected at a pressure of about 3 MPa initially, while steam and solvent are co-injected at a pressure of about 2 MPa to about 3.5 MPa during co-injection.

The solvent may be heated before or during injection to vaporize the solvent. Additionally or alternatively, solvent may be mixed or co-injected with steam to heat the solvent to vaporize it and to maintain the solvent in vapour phase. Depending on whether the solvent is pre-heated at surface, the weight ratio of steam in the injection stream should be high enough to provide sufficient heat to the co-injected solvent to maintain the injected solvent in the vapour phase. If the feed solvent from surface is in the liquid phase, more steam may be required to both vaporize the solvent and maintain the solvent in the vapour phase as the solvent travels through the production chamber.

In different embodiments, co-injection of steam and the solvent may be carried out in a number of different ways or manners as can be understood by those skilled in the art. For example, co-injection of the solvent and steam into the production chamber may include gradually increasing the weight ratio of the solvent in the co-injected solvent and steam, and gradually decreasing the weight ratio of steam in the co-injected solvent and steam. At a later stage, the solvent content in the co-injected solvent and steam may be gradually decreased, and the steam content in the co-injected solvent and steam may be gradually increased. For example, depending on market factors, the cost of solvent may change over the life of a steam-solvent process. During or after the solvent-steam process, it may be of economic benefit to gradually decrease the solvent content and gradually increase the steam content. Solvent injection is expected to result in increased mobility of at least some of the heavy hydrocarbons of reservoir formation 100. For example, some solvents such as propane and butane are expected to dissolve in and dilute heavy oil thus increasing the mobility of the oil. The effectiveness and efficiency of the solvent depends on the solubility and diffusion of the solvent in hydrocarbons. Slow diffusion or low solubility of the solvent in the hydrocarbons can limit the effect of the solvent on oil drainage rate. Therefore, the operation conditions may be modified to increase solvent diffusion and solubility to optimize process performance and efficiency. The term "mobility" is used herein in a broad sense to refer to the ability of a substance to move about, and is not limited to the flow rate or permeability of the substance in the reservoir. For example, the mobility of heavy hydrocarbons may be increased when they become more mobile, or when heavy hydrocarbons attached to sands become easier to detach from the sands, or when immobile heavy hydrocarbons become mobile, even if the viscosity or flow rate of the hydrocarbons has not changed. The mobility of heavy hydrocarbons may also be increased by decreasing the viscosity of the heavy hydrocarbons, or when the effective permeability, such as through bituminous sands, is increased. Additionally or alternatively, increasing heavy hydrocarbon mobility may be achieved by heat transfer from solvent to heavy hydrocarbons.

Additionally or alternatively, solvent may otherwise accelerate production. For example, a non-condensable gas, such as methane, may propel a solvent, such as propane, downwards thereby enhancing lateral growth of the production chamber. For example, such propulsion may be part of a blowdown phase.

Conveniently, a solvent-steam process where solvent is co-injected with steam requires less steam as compared to the SAGD production phase. Injection of less steam may reduce water and water treatment costs required for production. Injection of less steam may also reduce the need or costs for steam generation for an oil production project. Steam may be produced at a steam generation plant using boilers. Boilers may heat water into steam via combustion of hydrocarbons such as natural gas. A reduction in steam generation requirement may also reduce combustion of hydrocarbons, with reduced emission of greenhouse gases such as, for example, carbon dioxide.

Once the oil production process is completed, the operation may enter an ending or winding down phase, with a process known as the "blowdown" process. The "blowdown" phase or stage may be performed in a similar manner as in a conventional SAGD process. During the blowdown stage, a non-condensable gas may be injected into the reservoir to replace steam or the solvent. For example, the non-condensable gas may be methane. In addition, methane may enhance hydrocarbon production, for example by about 10% within 1 year, by pushing the already injected solvent through the chamber.

Alternatively, in an embodiment a solvent may be continuously utilized through a blowdown phase, in which case it is possible to eliminate or reduce injection of methane during blowdown. In particular, it is not necessary to implement a conventional blowdown phase with injected methane gas, when a significant portion of the injected solvent can be readily recycled and reused. In some embodiments, during or at the end of the blowdown phase, methane or another non-condensable gas (NCG) may be used to enhance solvent recovery, where the injected methane or other non-condensable gas may increase solvent condensation and thus improve solvent recovery. For example, injected methane or other NCG may mobilize gaseous solvent in the chamber to facilitate removal of the solvent.

During the blowdown phase, oil recovery or production may continue with production operations being maintained. When methane is used for blowdown, oil production performance will decline over time as the growth of the vapour front in production chamber slows under methane gas injection.

At the end of the production operation, the injection wells may be shut in but solvent (and some oil) recovery may be continued, followed by methane injection to enhance solvent recovery. The formation fluid may be produced until further recovery of fluids from the reservoir is no longer economical, e.g. when the recovered oil no longer justifies the cost for continued production, including the cost for solvent recycling and re-injection. In some embodiments, before, during or after the blowdown phase, production of fluids from the reservoir through production well 130 may continue. An embodiment of the production control process disclosed herein may be used, or adapted to use, during the blowdown phase to control the produced gas phase such as methane when steam and methane are produced during the blowdown phase. The solvent for injection may be selected based on a number of criteria. As discussed above, the solvent should be injectable as a vapour, and can dissolve at least one of the heavy hydrocarbons to be recovered from reservoir 100 in the solvent-steam process for increasing mobility of the heavy hydrocarbons. Conveniently, increased hydrocarbon mobility can enhance drainage of the reservoir fluid toward and into production well 130. In a given application, the solvent may be selected based on its volatility and solubility in the reservoir fluid. For example, in the case of a reservoir with a thinner pay zone (e.g., the pay zone thickness is less than about 8 m), or a reservoir having a top gas zone or water zone, the solvent may be injected in a liquid phase in the solvent-steam process.

Suitable solvents may include C3 to C5 hydrocarbons such as, propane, butane, pentane, or a combination thereof such as in a diluent composition. Additionally or alternatively, a C6 hydrocarbon such as hexane could be employed. A combination of solvents including C3-C6 hydrocarbons and one or more heavier hydrocarbons may also be suitable in some embodiments. Suitable solvents may include a condensate. Condensates often comprise hydrocarbons in the range of C3 to C12 or higher. The condensates may primarily comprise light end compounds—those hydrocarbons of such a mixture having the lowest number of carbon atoms, typically C1 to C7, but possibly higher in some cases. Such light end compounds have the lowest molecular weights, and are generally the more volatile of the hydrocarbon compounds of the mixture. Solvents that are more volatile, such as those that are gaseous at standard temperature and pressure (STP), or significantly more volatile than steam at reservoir conditions, such as propane or butane, or even methane, may be beneficial in some embodiments.

For selecting a suitable solvent, the properties and characteristics of various candidate solvents may be considered and compared. For a given selected solvent, the corresponding operating parameters during co-injection of the solvent with steam should also be selected or determined in view the properties and characteristics of the selected solvent.

In particular, the injection temperature should be sufficiently high and the injection pressure should be sufficiently low to ensure most of the solvent will be injected in the vapour phase into the production chamber. In this context, injection temperature and injection pressure refer to the temperature and pressure of the injected fluid in the injection well, respectively. The temperature and pressure of the injected fluid in the injection well may be controlled by adjusting the temperature and pressure of the fluid to be injected before it enters the injection well. The injection temperature, injection pressure, or both, may be selected to ensure that the solvent is in the gas phase upon injection from the injection well into the production chamber. Solvents may be selected having regard to reservoir characteristics such as, the size and nature of the pay zone in the reservoir, properties of fluids involved in the process, and characteristics of the formation within and around the reservoir. For example, a relatively light hydrocarbon solvent such as propane may be suitable for a reservoir with a relatively thick pay zone, as a lighter hydrocarbon solvent in the vapour phase is typically more mobile within the heated production chamber.

Additionally or alternatively, solvent selection may include consideration of the economics of heating a selected particular solvent to a desired injection temperature. For example, as can be appreciated by those skilled in the art, lighter solvents, such as propane and butane, can be efficiently injected in the vapour phase at relatively low temperatures at a given injection pressure. In comparison, efficient pure steam injection in a SAGD process typically requires a much higher injection temperature, such as about 200° C. or higher.

Heavier solvents typically also require a higher injection temperature. For example, pentane may need to be heated to about 190° C. for injection in the vapour phase at injection pressures up to about 3 MPa. In comparison, a light solvent such as propane may be injected at temperatures as low as about 50° C. to about 70° C. depending on the reservoir pressure.

Different solvents or solvent mixtures may be suitable candidates. For example, the solvent may be propane, butane, or pentane. A mixture of propane and butane may also be used in an appropriate application. It is also possible that a selected solvent mixture may include heavier hydrocarbons in proportions that are, for example, low enough that the mixture still satisfies the above described criteria for selecting solvents.

In some embodiments, the vapour pressure profile of the solvent may be selected such that the partial pressure of the solvent in a central (core) region of the production chamber is within about 0.25% to about 20% of the total gas pressure, or the vapour pressure of water/steam.

It may be desirable if the solvent and steam can vaporize and condense under similar temperature and pressure conditions, which will conveniently allow vapour of the solvent to initially rise up with the injected steam to penetrate the rock formation in the production chamber, and then condense with the steam to form a part of the mobilized reservoir fluid. For example, in some embodiments, the solvent may have a boiling point that resembles the boiling point of water under the steam injection conditions such that it is sufficiently volatile to rise up with the injected steam in vapour form when penetrating the steam chamber and then condense at the edge of the steam chamber. The boiling temperature of the solvent may be near the boiling temperature of water at the same pressure.

Conveniently, when the solvent has vaporization characteristics that resemble, closely match, those of water under the reservoir conditions, the solvent can condense when it reaches the steam front or the edge of the steam chamber, which is typically at a lower temperature such as at about 12° C. to about 150° C. The condensed solvent may be soluble in or miscible with either the hydrocarbons in the reservoir fluid or the condensed water, so as to increase the drainage rate of the hydrocarbons in the fluid through the reservoir formation.

The condensed solvent is soluble in oil, and thus can dilute the oil stream, thereby increasing the mobility of oil in the fluid mixture during drainage. In some embodiments, the condensed solvent is also soluble in or miscible with the condensed water, which may lead to increased water flow rate by promoting formation of oil-in-water emulsions. Without being limited to any particular theory, the dispersion of the solvent and the steam may facilitate the formation of an oil-in-water emulsion under suitable reservoir conditions and also increase the fraction of oil carried by the fluid mixture. As a result, more oil may be produced for the same amount of, or less, steam, which is desirable.

A possible mechanism for improving mobility of oil is that the solvent can act as a diluent due to its solubility in oil and optionally water, thus reducing the viscosity of the resulting fluid mixture. The solvent may interact at the oil surface to reduce capillary and viscosity forces.

A vapour mixture of steam and the solvent may be delivered into production chamber using any suitable delivery mechanism or route. For example, injection well 120 may be conveniently used to deliver the vapour mixture. A mobilizing fluid or agent may be injected in the form of a mixture of steam and solvent (e.g., mixed ex-situ), or separate streams may be injected into the injection well 120 for mixing in the injection well 120.

EXAMPLES

State-of-the-art simulation protocols were used to compare an archetypal method of the present disclosure to a conventional SDP process using a well characterized field well to set reservoir parameters. Average properties for the well are set out in Table 1.

TABLE 1

Simulation properties for comparison of a conventional SDP method with a method in accordance with the present disclosure.

| Property | Units | Value |
|---|---|---|
| Solid | N/A | McMurray Sand |
| KH | D | 0-6 |
| KV | D | 0-5 |
| Porosity | N/A | 0-0.33 |
| Solvent injection | wt % | 60 |
| Pay Thickness | m | 15 |
| Well Length | m | 900 |

Simulations were conducted for conventional SAGD completions, ICD-based completions in accordance with methods of the present disclosure, and UPP-based completions in accordance with the present disclosure.

Figure 3:
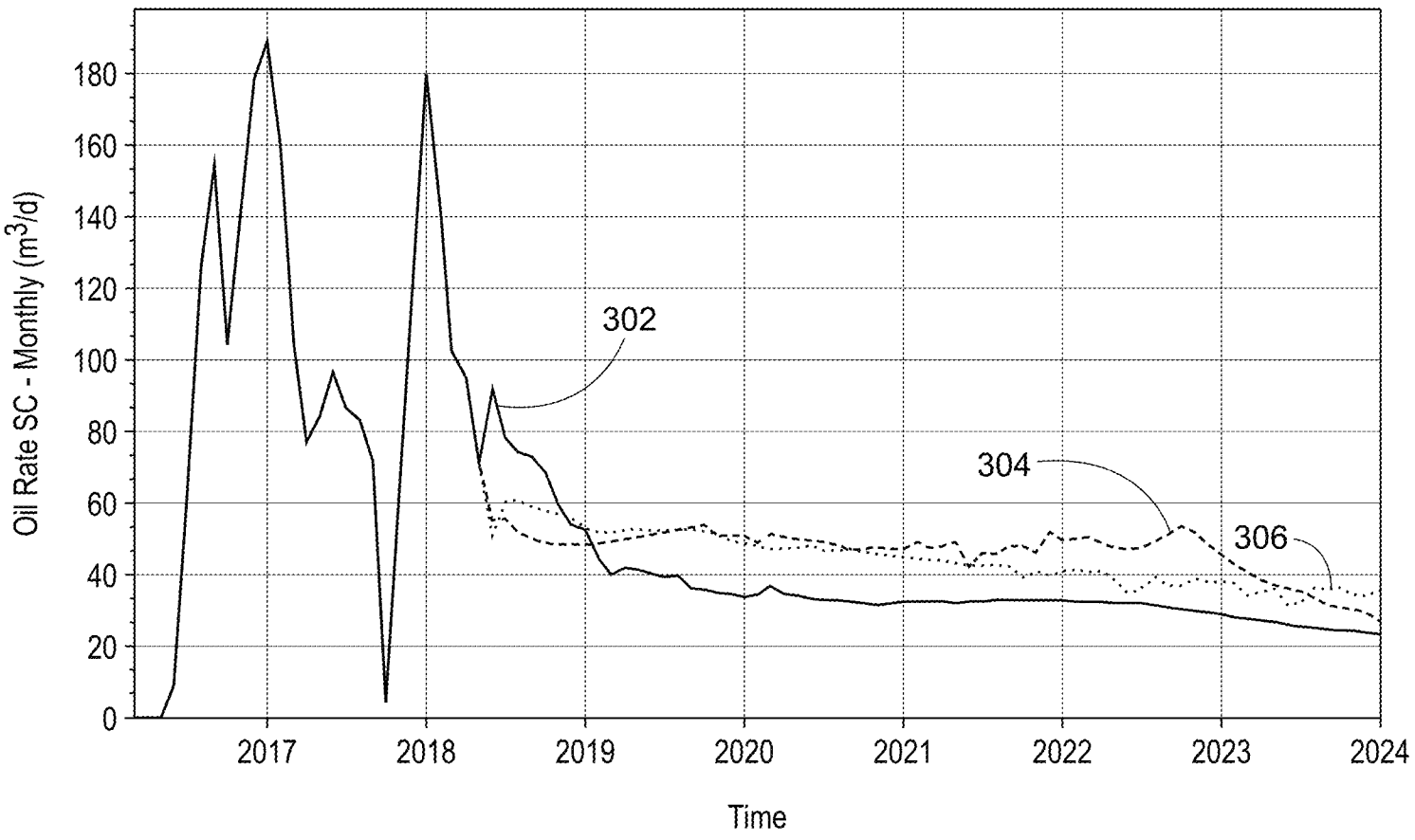
FIG. 3 shows simulation results for oil rate as a function of time for methods of the present disclosure as compared to a conventional SDP method.

FIG. 3 shows simulation results for oil rate as a function of time for the various processes. In FIG. 3, the plot for the completion is identified by reference number 302, the plot for the ICD-based completion is identified by reference number 304, and the plot for the UPP-based completion is identified by reference number 306. Comparing plots 304 and 306 against plot 302 indicates that the oil rate for the re-completed wells (ICDs and UPPs) are higher than that of the SDP case for the majority of the simulation. As set out above, this uplift in oil rate runs counter to conventional wisdom—the simulation indicates that the methods of the present disclosure may provide high oil rates despite restricting flow at the fluid-inlet components.

Figure 4:
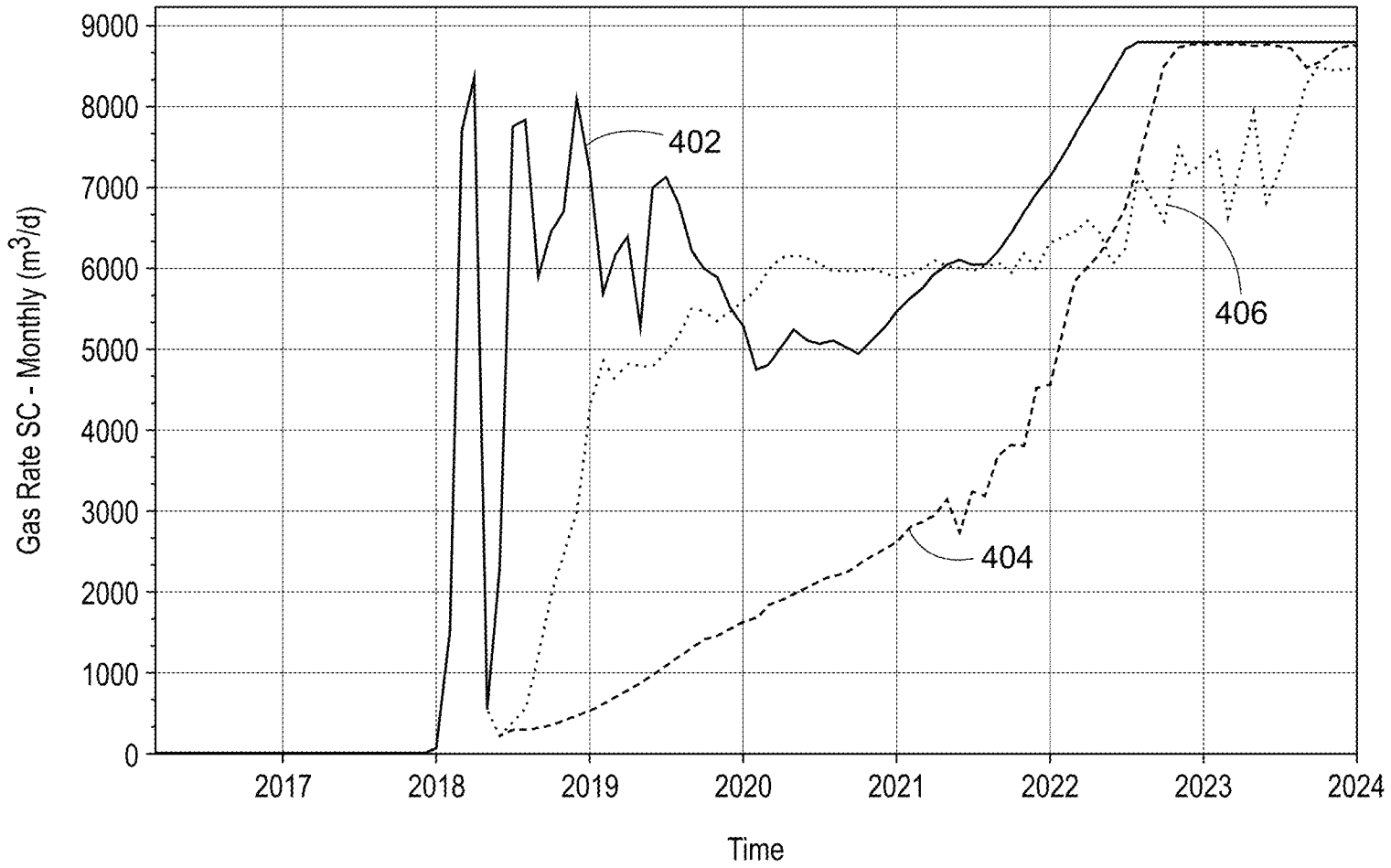
FIG. 4 shows simulation results for gas rate as a function of time for methods of the present disclosure as compared to a conventional SDP method.

FIG. 4 shows simulation results for gas rate as a function of time for the various processes. In FIG. 4, the plot for the conventional completion is identified by reference number 402, the plot for the ICD-based completion is identified by reference number 404, and the plot for the UPP-based completion is identified by reference number 406. Comparing plots 404 and 406 against plot 402 indicates that both ICDs and UPPs restrict the amount of gas produced as desired relative to the conventional case. These simulations indicate an important result in that retaining gas within the reservoir during production is desirable. As set out above, this may reduce gas-bottlenecking at the plant and may improve project economics by reducing solvent costs.

Figure 5:
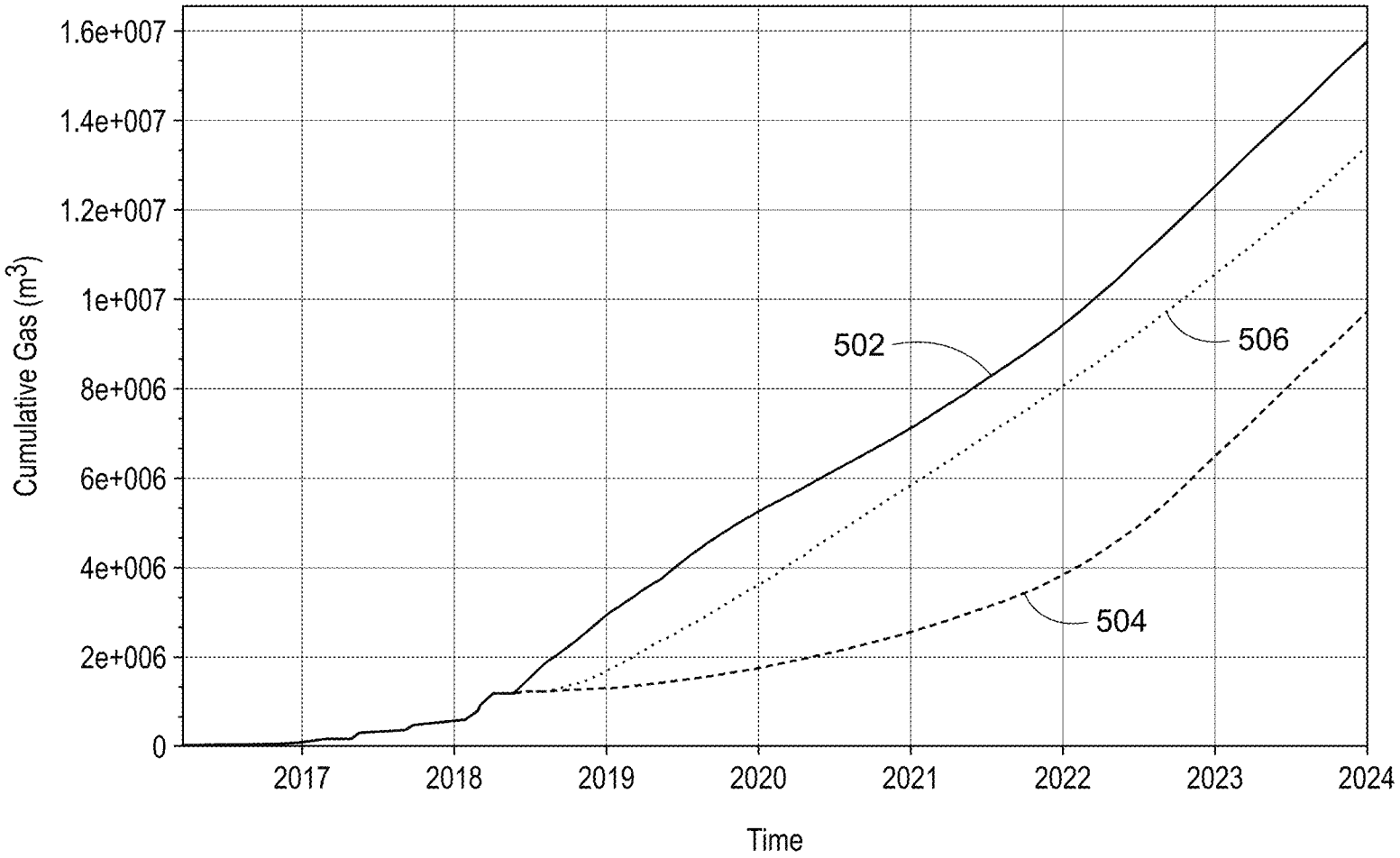
FIG. 5 shows simulation results for cumulate gas production as a function of time for methods of the present disclosure as compared to a conventional SDP method.

FIG. 5 shows simulation results for cumulative gas production as a function of time for the various processes. In FIG. 5, the plot for the conventional completion is identified by reference number 502, the plot for the ICD-based completion is identified by reference number 504, and the plot for the UPP-based completion is identified by reference number 506. Comparing plots 504 and 506 against plot 502 indicates that the cumulative amount of gas produced when using ICDs or UPPs is lower than that of the base completion. These simulations indicate a 16% reduction in the amount of gas produced when using UPPs and 40% reduction when using ICDs.

Figure 6:
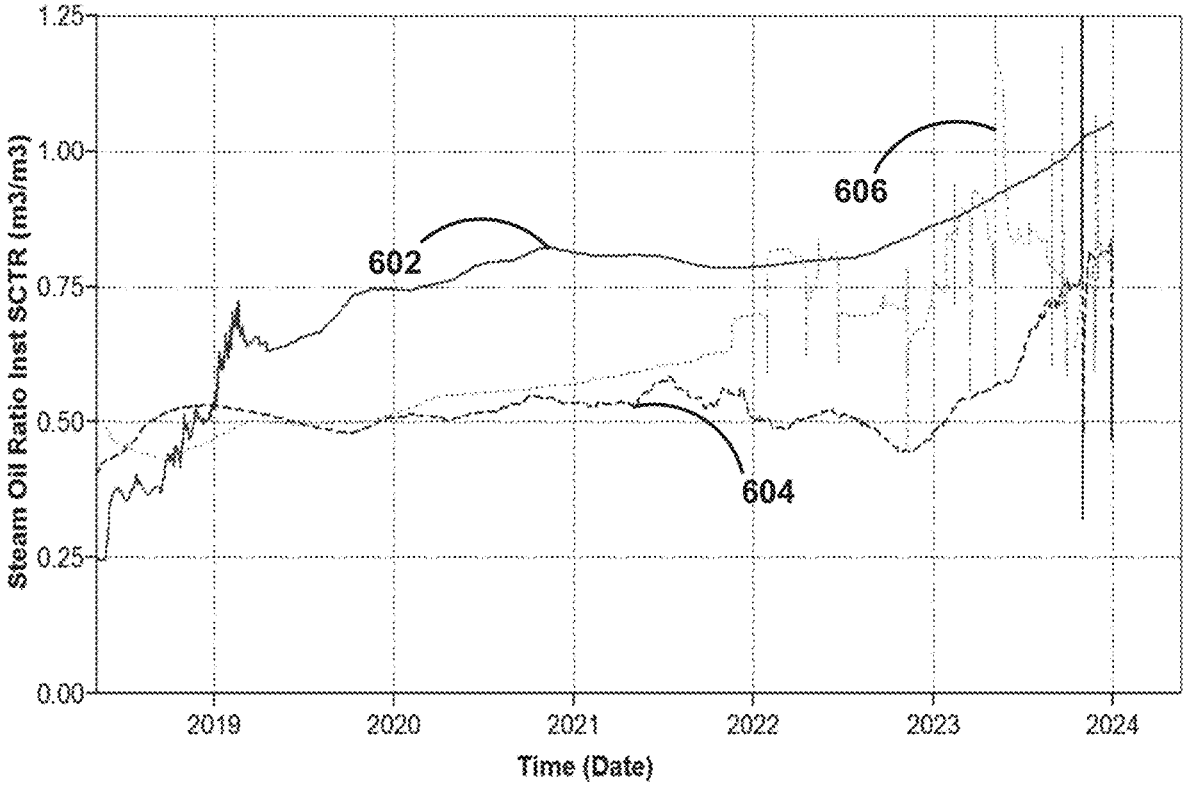
FIG. 6 shows simulation results for instantaneous steam-oil ratio (iSOR) as a function of time for methods of the present disclosure as compared to a conventional SDP method.

FIG. 6 shows simulation results for instantaneous steam-oil ratio (iSOR) as a function of time for the various processes. In FIG. 6, the plot for the conventional completion is identified by reference number 602, the plot for the ICD-based completion is identified by reference number 604, and the plot for the UPP-based completion is identified by reference number 606. These simulations suggest that both ICD- and UPP-base methods have a the potential for significant iSOR improvements, for example by reducing by at least about 17%.

Figure 7:
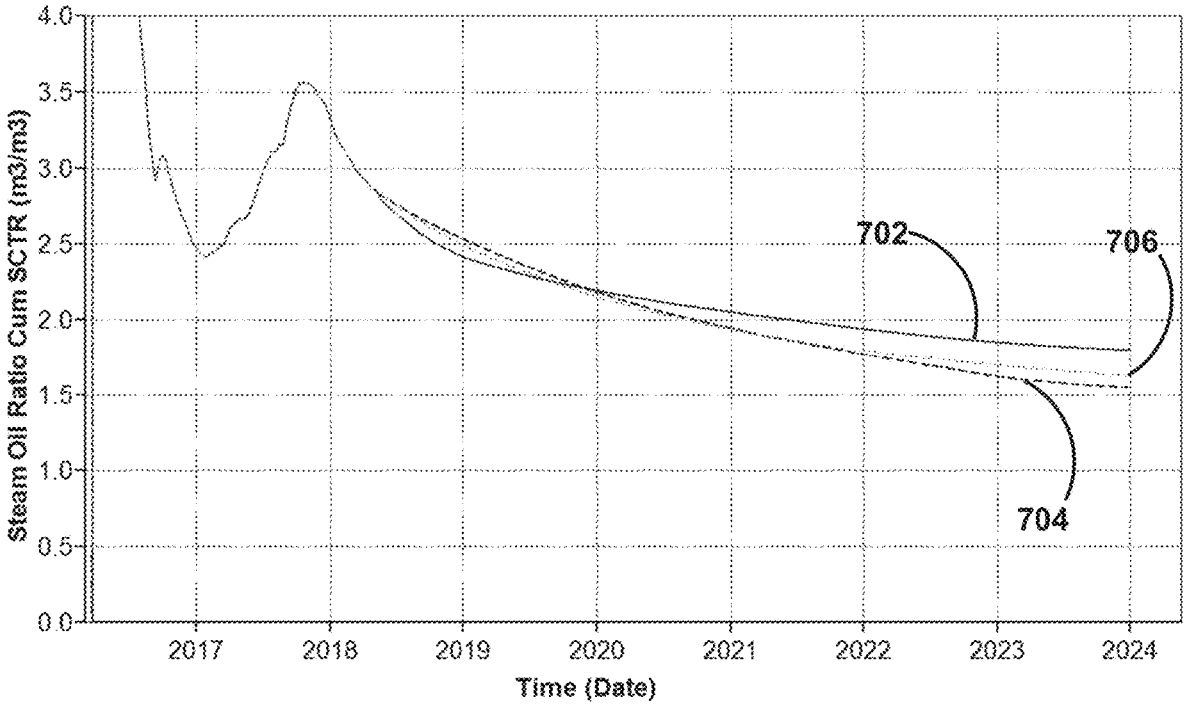
FIG. 7 shows simulation results for cumulative steam-oil ratio (cSOR) as a function of time for methods of the present disclosure as compared to a conventional SDP method.

FIG. 7 shows simulation results for cumulative steam-oil ratio (cSOR) as a function of time for the various processes. In FIG. 7, the plot for the conventional completion is identified by reference number 702, the plot for the ICD-based completion is identified by reference number 704, and the plot for the UPP-based completion is identified by reference number 706. Similar to iSOR reduction, the simulations for cSOR reduction also indicate potential advantages, as they suggest a cSOR improvement of approximately 14% for the duration of the simulation. Importantly, this could result in significant steam generation cost and GHG emissions reduction per well.

Figure 8:
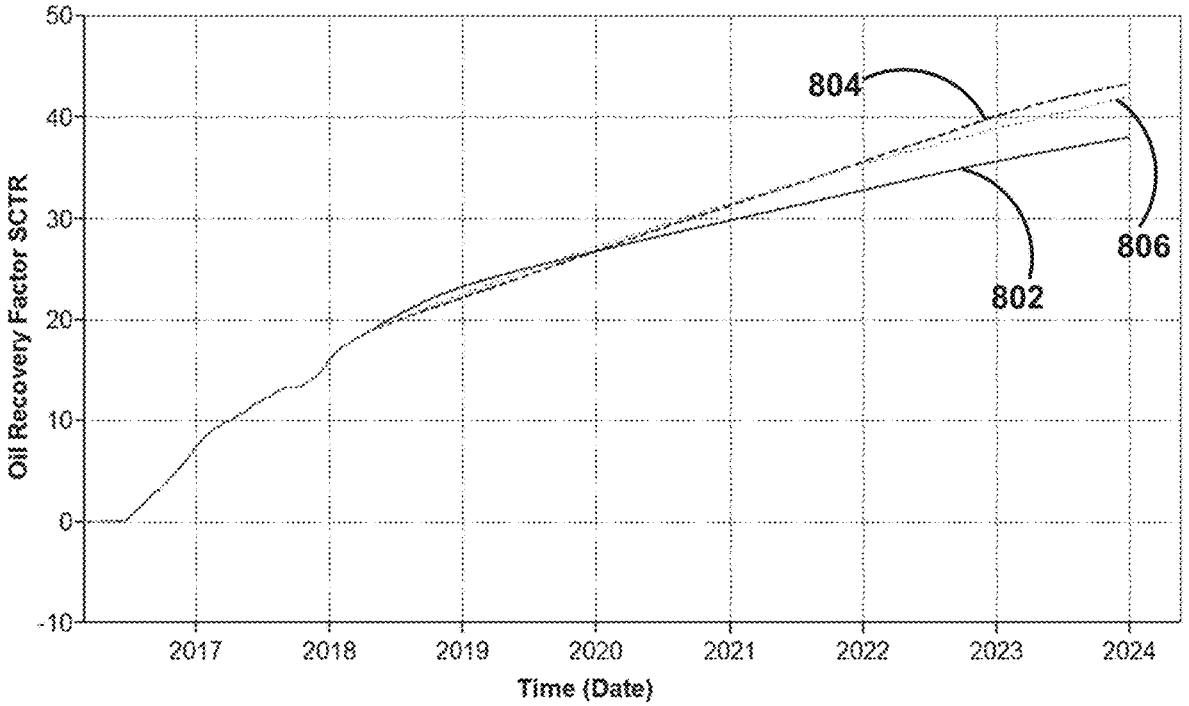
FIG. 8 shows simulation results for oil recovery factor as a function of time for methods of the present disclosure as compared to a conventional SDP method.

FIG. 8 shows simulation results for oil recovery factor as a function of time for the various processes. In FIG. 8, the plot for the conventional completion is identified by reference number 802, the plot for the ICD-based completion is identified by reference number 804, and the plot for the UPP-based completion is identified by reference number 806. When looking at the oil recovery factor for the three cases, the ICD-based simulation indicates an increase of approximately 14% and UPP-based simulation indicates an increase of 10.5%. Importantly, the ICD- and UP-based simulations produce (and exceed) the same oil recovery as the conventional completion case but achieve it two years earlier. This indicates the potential for project-economics improvements as characterized by net-present value (NPV) determinations.

Figure 9:
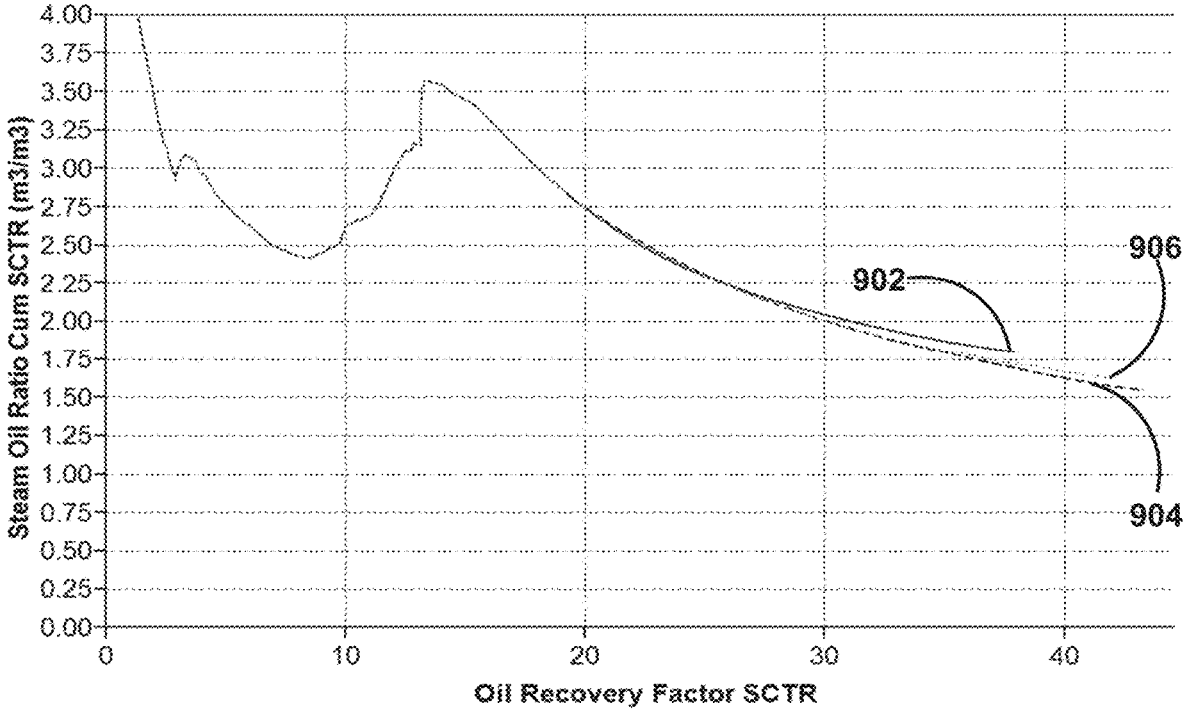
FIG. 9 shows simulation results for cSOR as a function of oil-recovery factor for methods of the present disclosure as compared to a conventional SDP method.

FIG. 9 shows simulation results for cSOR as a function of oil-recovery factor for the various processes. In FIG. 9, the plot for the conventional completion is identified by reference number 902, the plot for the ICD-based completion is identified by reference number 904, and the plot for the UPP-based completion is identified by reference number 906. Evaluating cSOR at various recovery factors may be a reliable metric when comparing various scenarios. In this case, at 35% recover factor the conventional completion case, the ICD case, and the UPP-case have cSOR values of 1.87, 1.80 and 1.80 respectively, which indicates a further potential advantage of the methods of the present disclosure.

Figure 10:
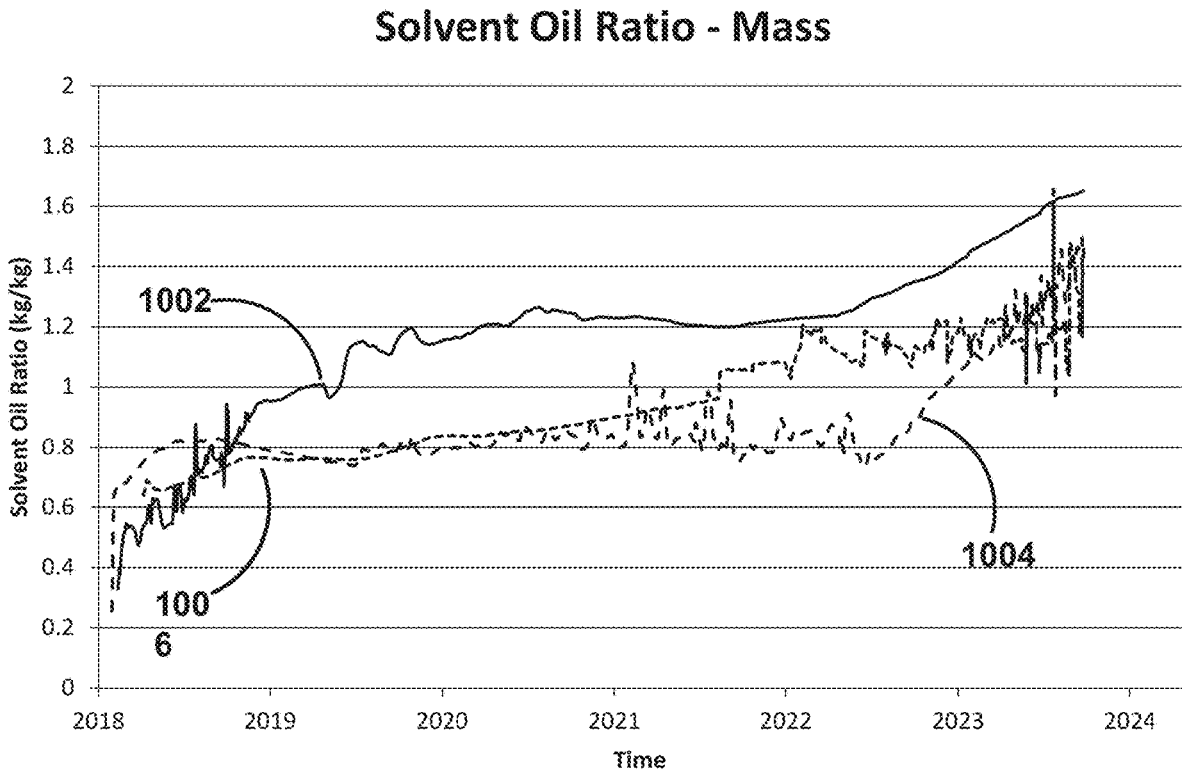
FIG. 10 shows simulation results for solvent-to-oil ratio as a function of time for methods of the present disclosure as compared to a conventional SDP method.

FIG. 10 shows simulation results for solvent-to-oil ratio as a function of time for the various processes. In FIG. 10, the plot for the conventional completion is identified by reference number 1002, the plot for the ICD-based completion is identified by reference number 1004, and the plot for the UPP-based completion is identified by reference number 1006. In the present context, The lower the solvent-to-oil ratio is for a process, the more economic it will be. For these simulation, the rate of solvent injected was held constant. As can be seen in FIG. 10 both the ICD-based and UPP-based cases reduce the solvent to oil ratio improving project economics compared to that of the conventional completion case. This reduction in solvent to oil ratio may improve the NPV of the project as there is more positive cash flow per unit of solvent injected.

Figure 11A:
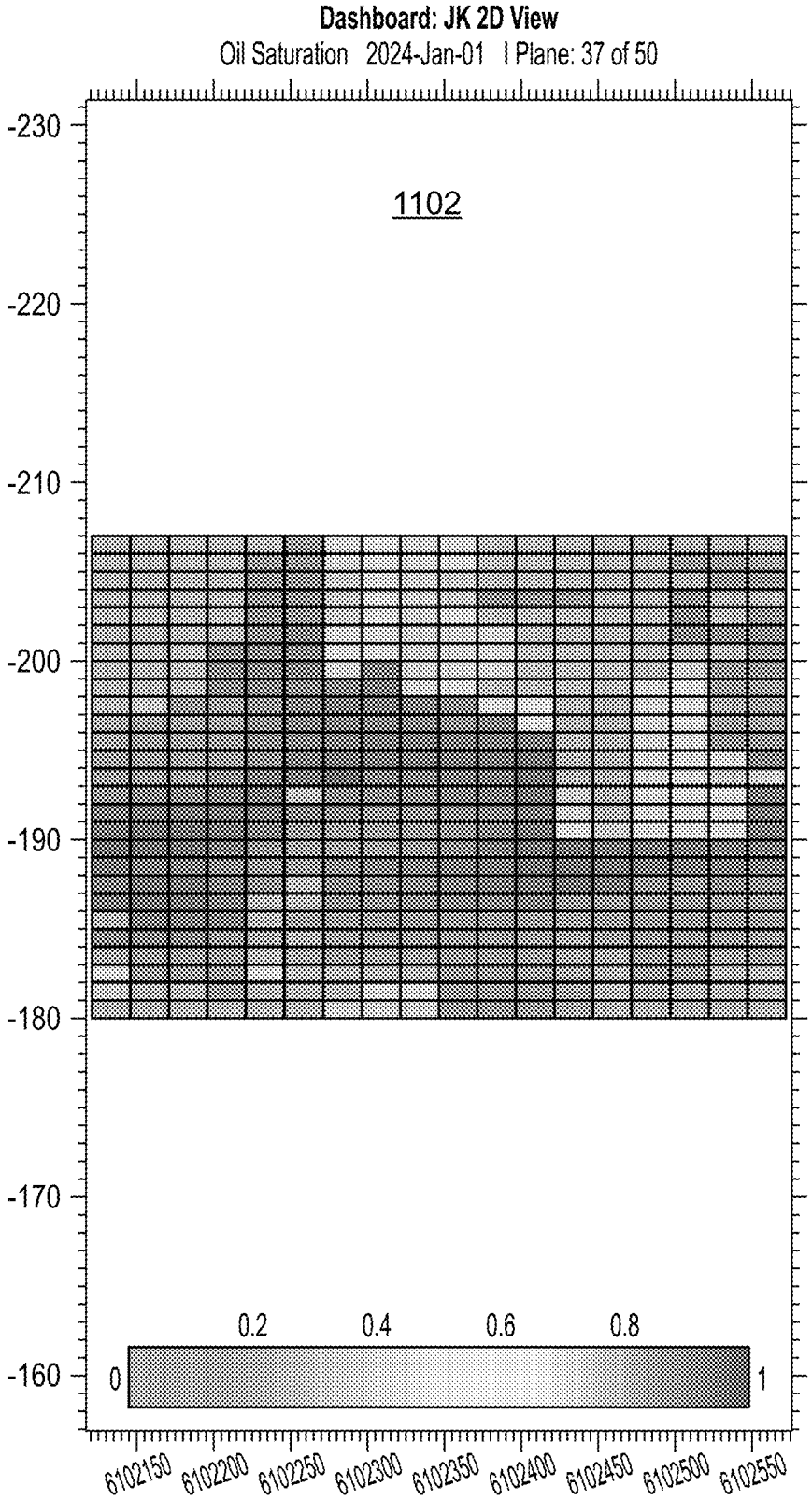
FIGS. 11A, 11B and 11C show simulation results for the oil saturations of wells in the JK plane for methods of the present disclosure as compared to a conventional SDP method.
Figure 11B:
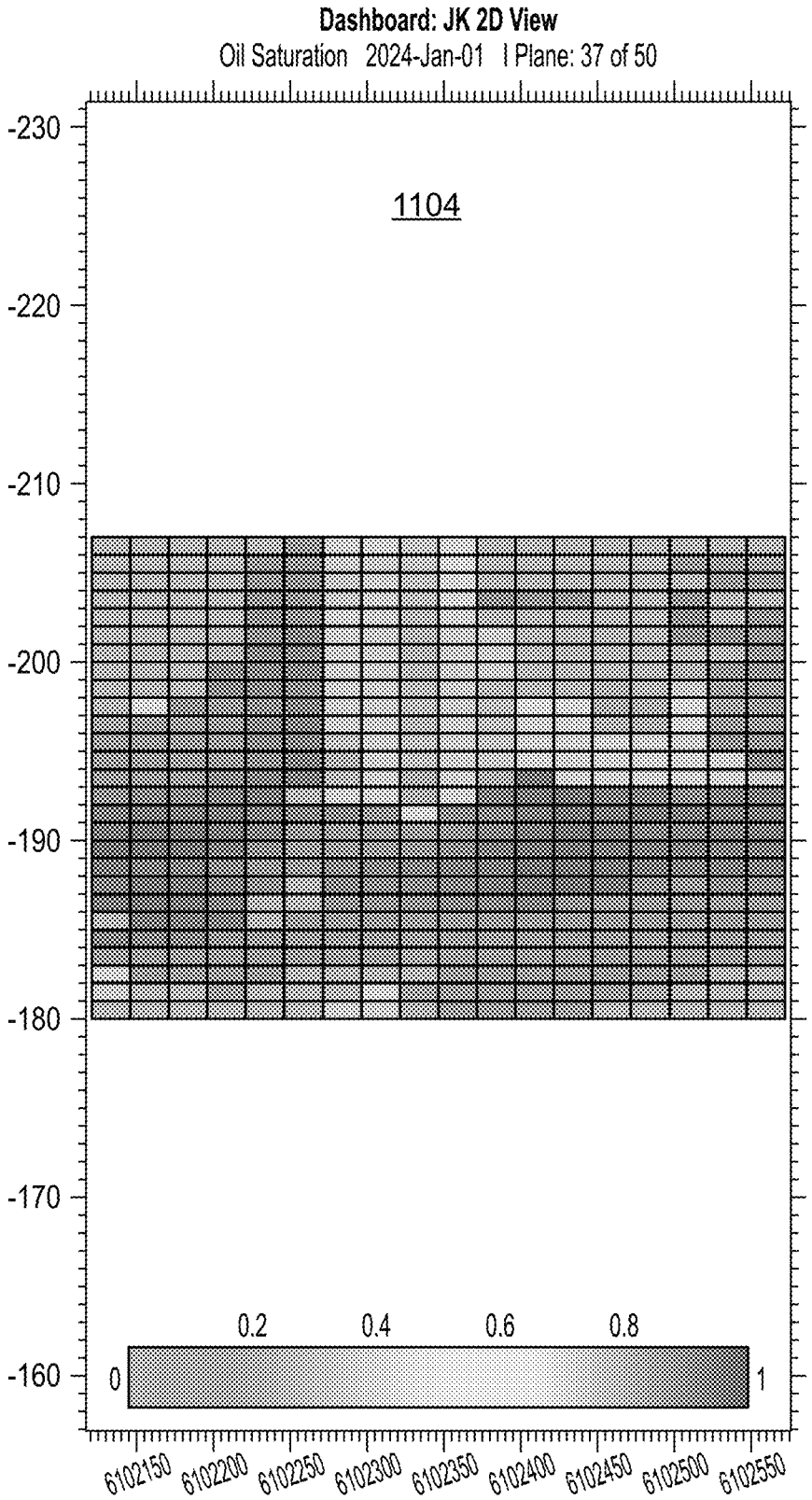
Figure 11C:
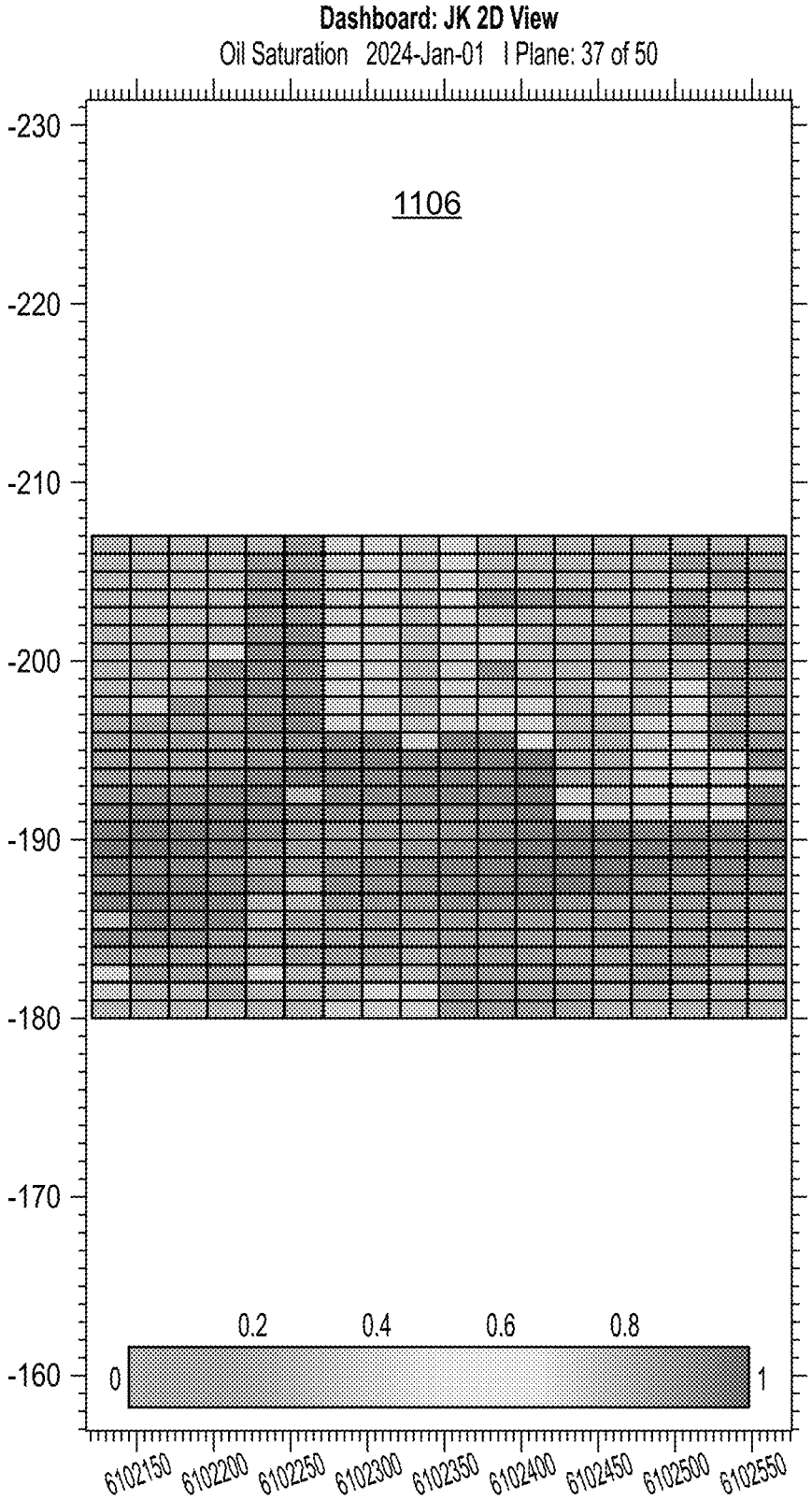
Figure 12A:
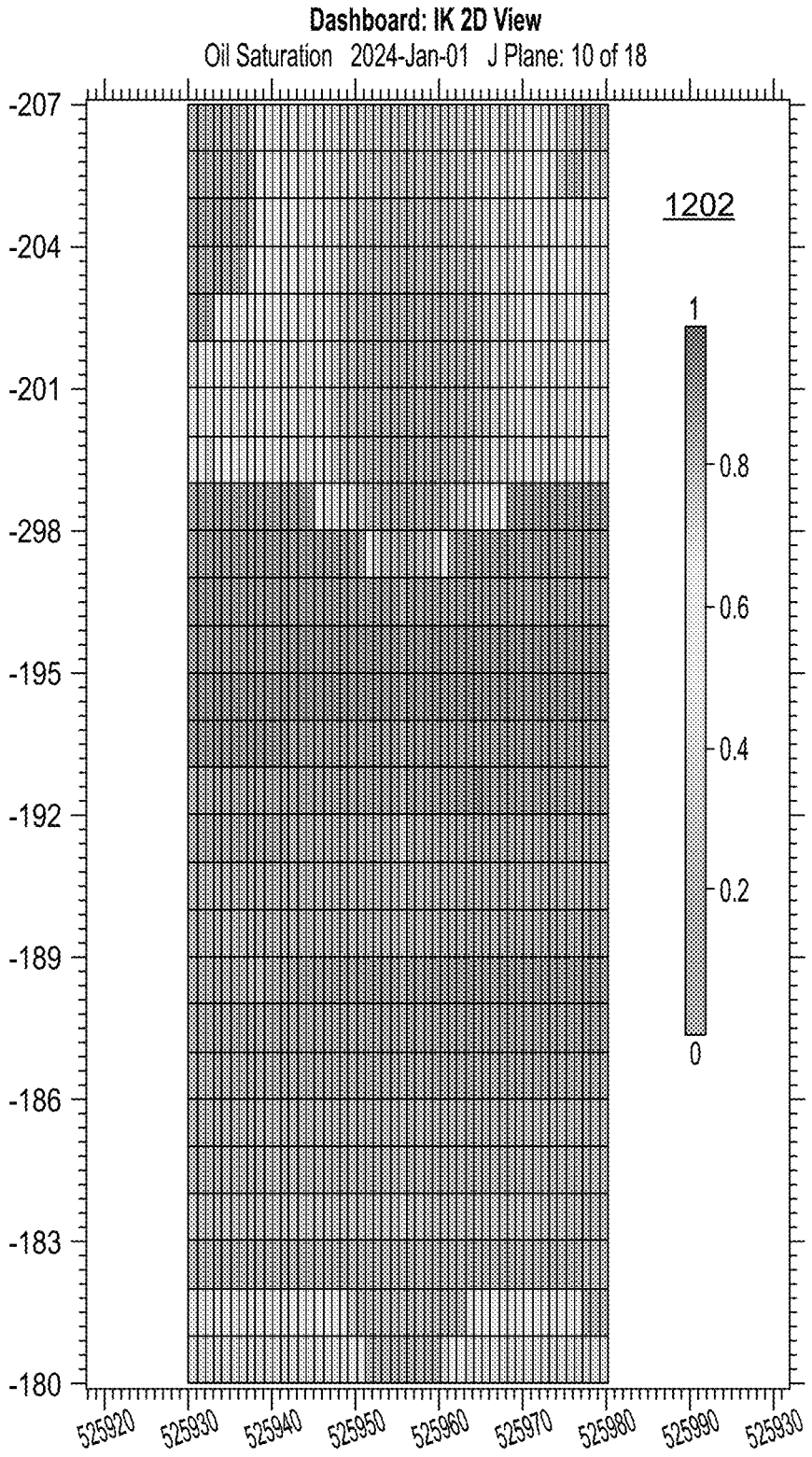
FIGS. 12A, 12B and 12C show simulation results for the oil saturations of the wells in the IK plane for methods of the present disclosure as compared to a conventional SDP method.
Figure 12B:
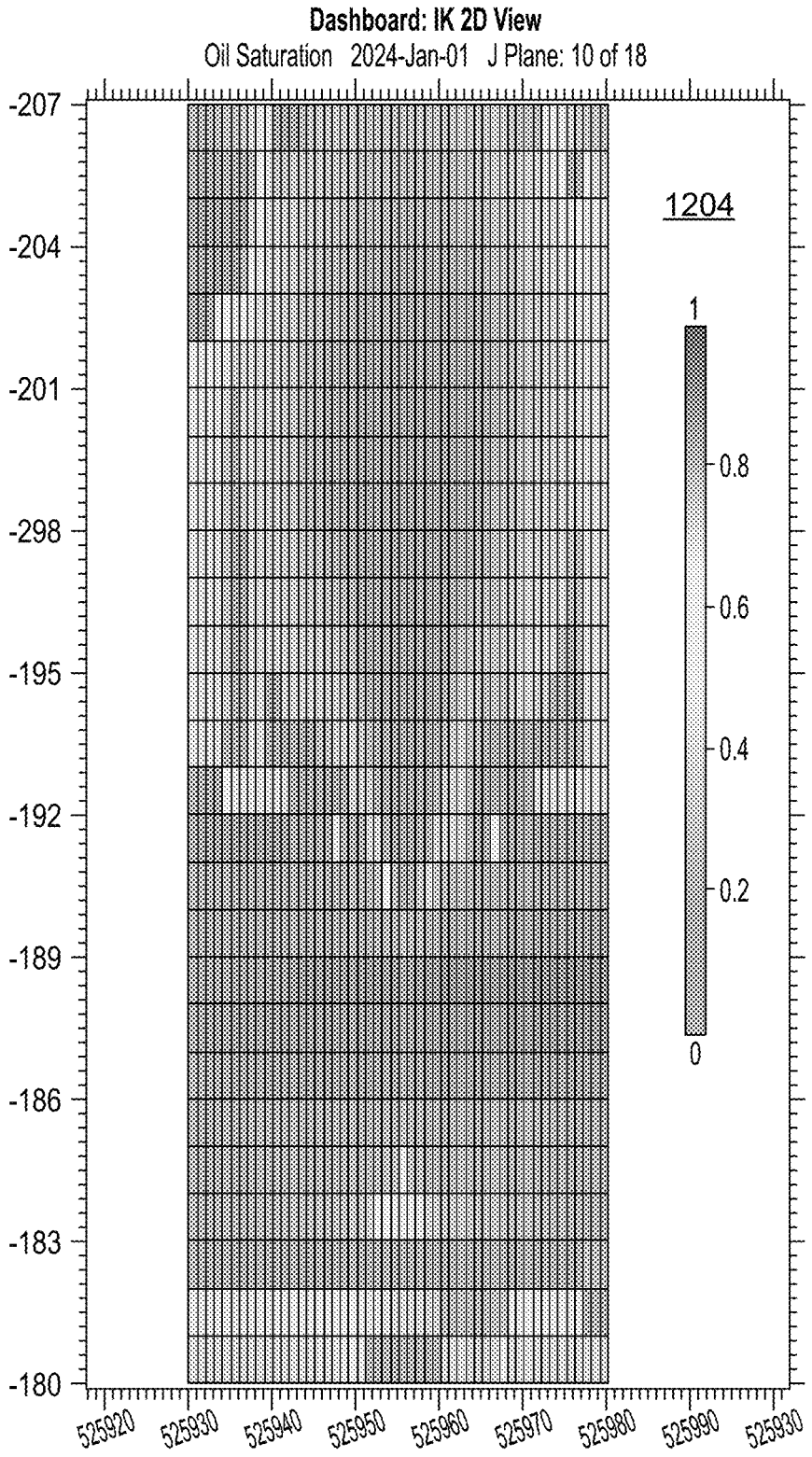
Figure 12C:
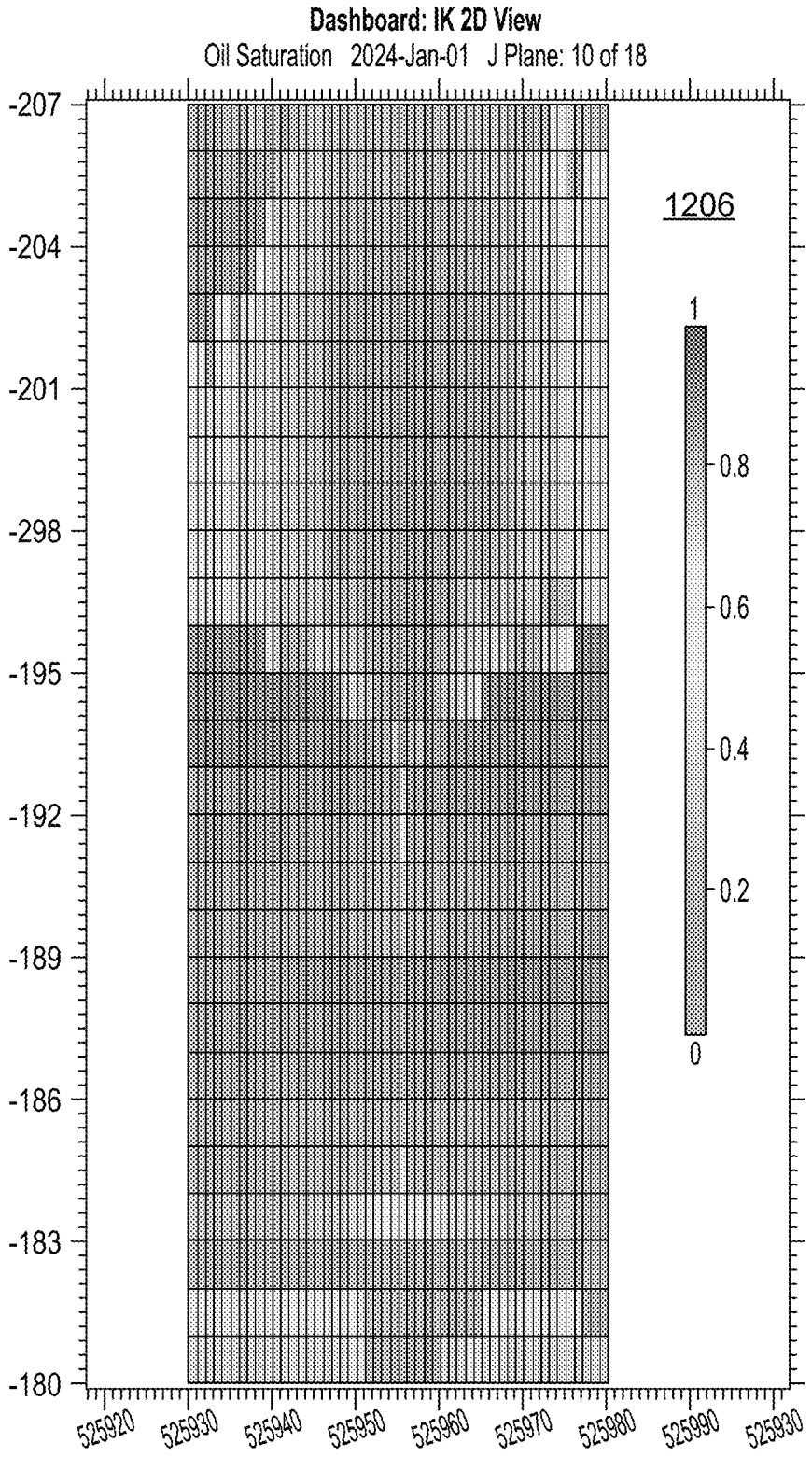

FIGS. 11A, 11B and 11C show the oil saturations of the wells in the JK plane (37 of 50). In FIGS. 11A, 11B and 11C, the panel for the conventional completion is identified by reference number 1102, the panel for the ICD-based completion is identified by reference number 1104, and the panel for the UPP-based completion is identified by reference number 1106. FIGS. 12A, 12B and 12C show the oil saturations of the wells in the IK plane (10 of 18). In FIGS. 12A, 12B and 12C, the panel for the conventional completion is identified by reference number 1202, the panel for the ICD-based completion is identified by reference number 1204, and the panel for the UPP-based completion is identified by reference number 1206. Both views clearly show that oil has been produced more effectively in the reservoir that uses ICDs. Likewise, both views clearly show that oil has been produced more effectively in the reservoir that uses UPPs. This simulation highlights the potential for the methods of the present disclosure to have positive effects on oil production.

Figure 13A:
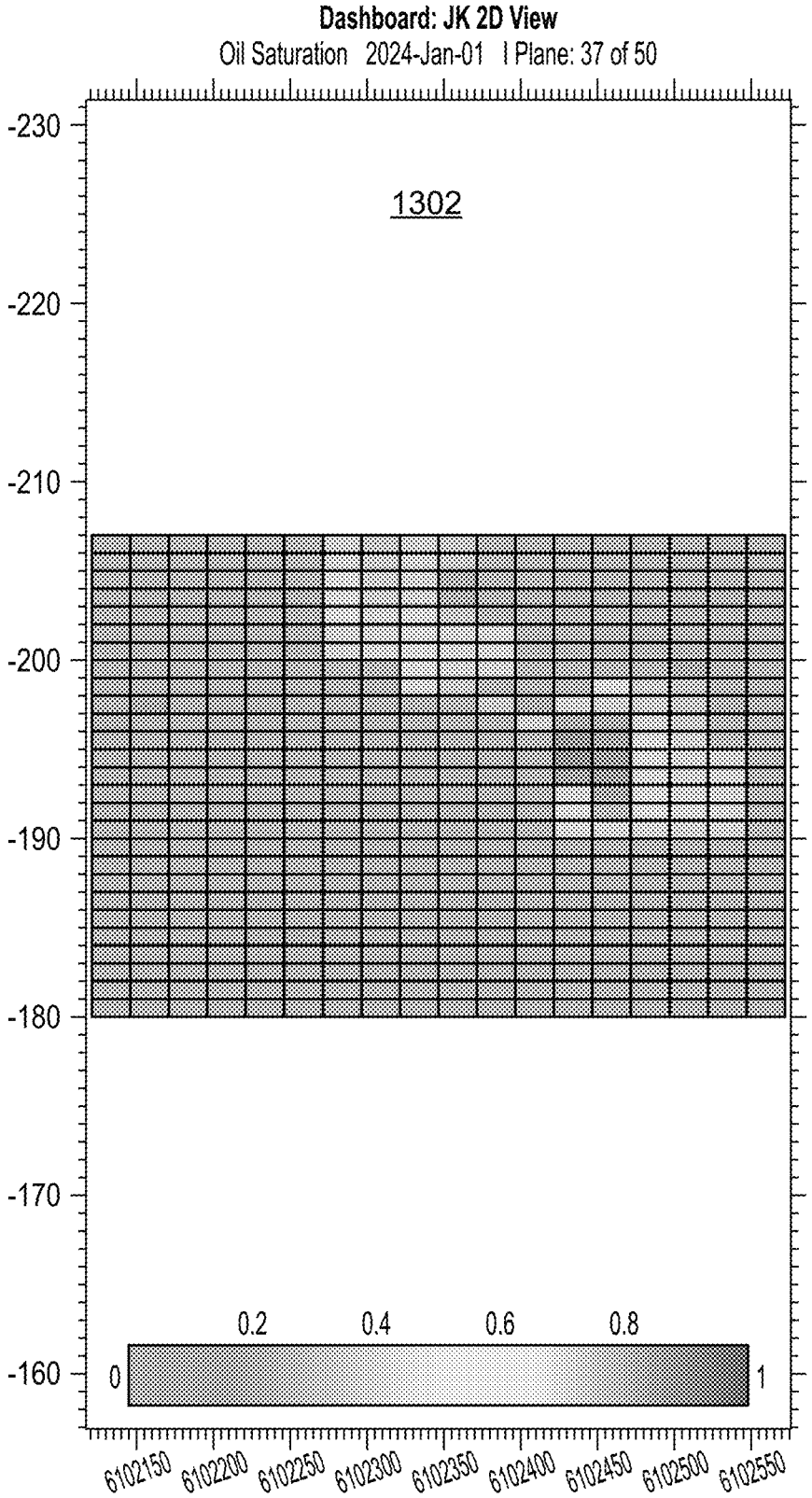
FIGS. 13A, 13B and 13C show simulation results for the gas saturations of the wells in the JK plane for methods of the present disclosure as compared to a conventional SDP method.
Figure 13B:
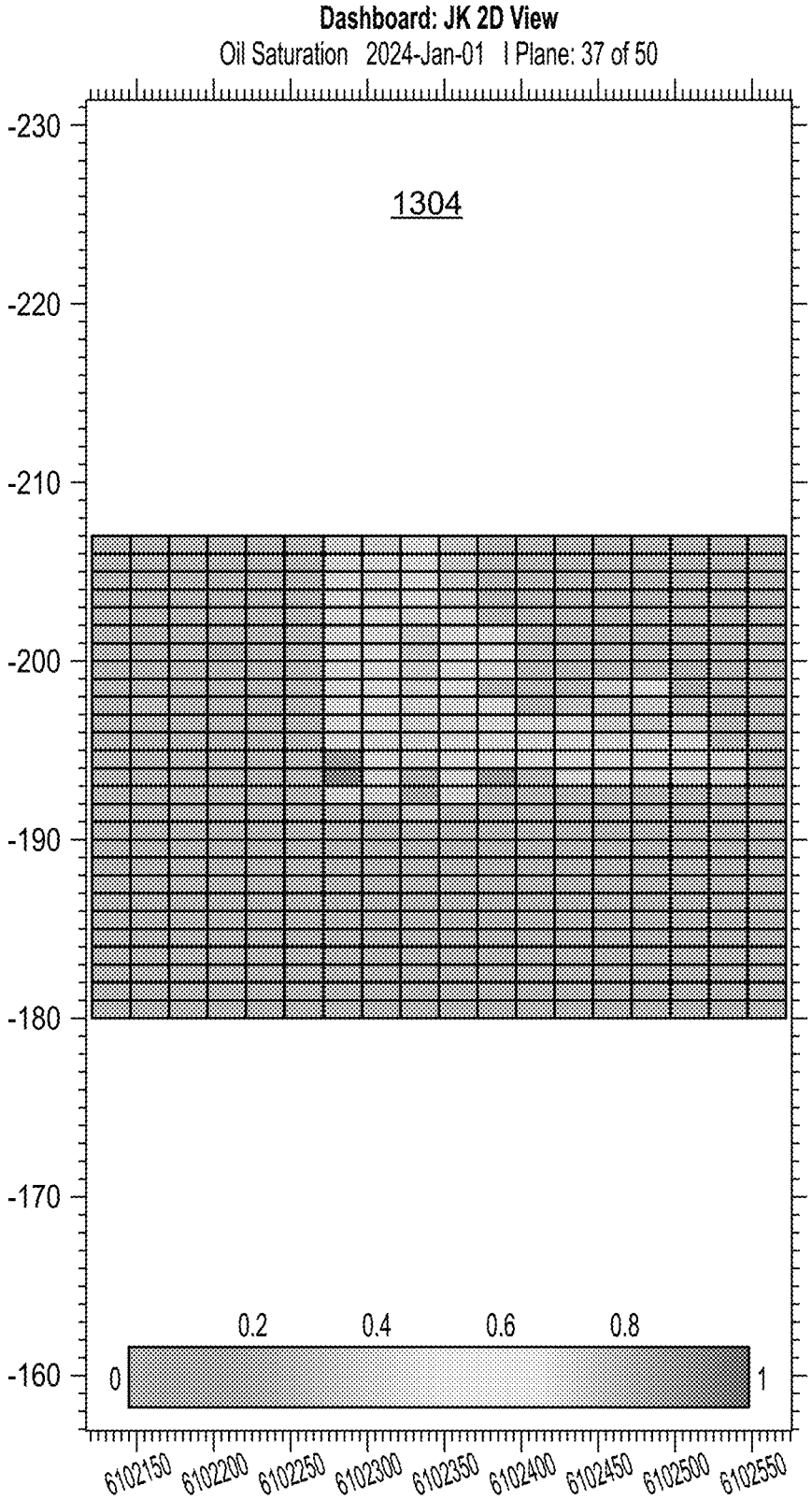
Figure 13C:
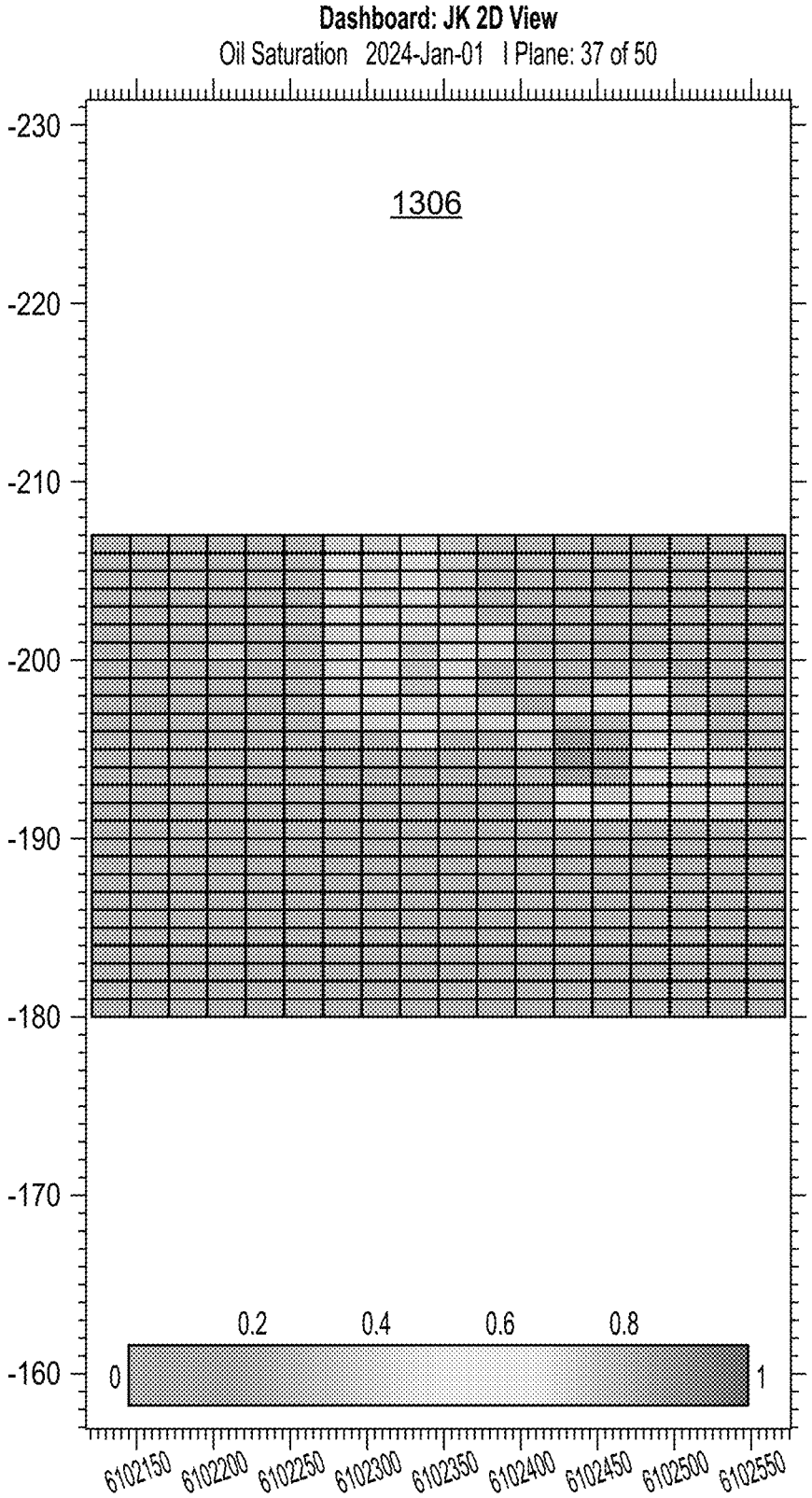
Figure 14A:
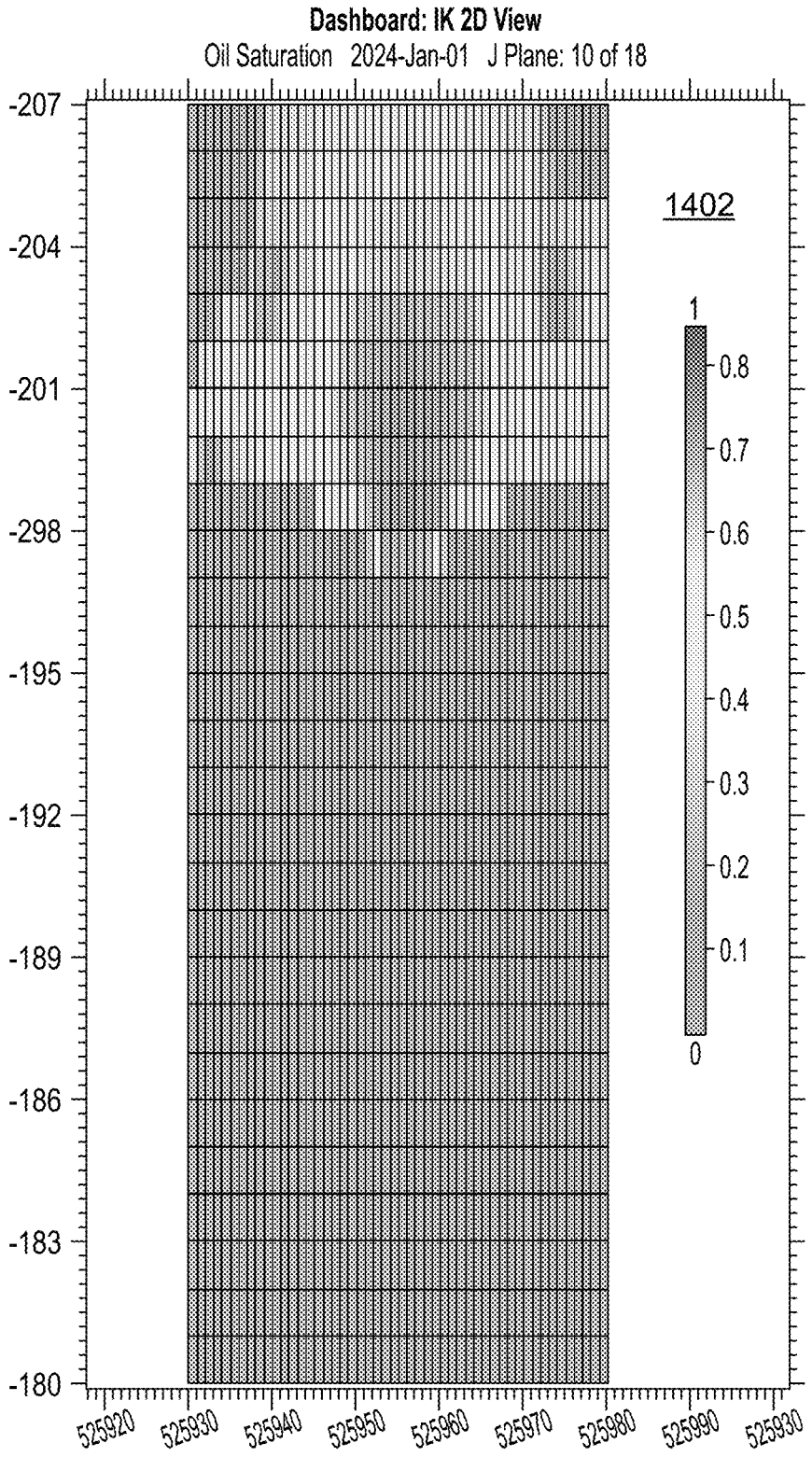
FIGS. 14A, 14B and 14C show simulation results for the gas saturations of the wells in the IK plane for methods of the present disclosure as compared to a conventional SDP method.
Figure 14B:
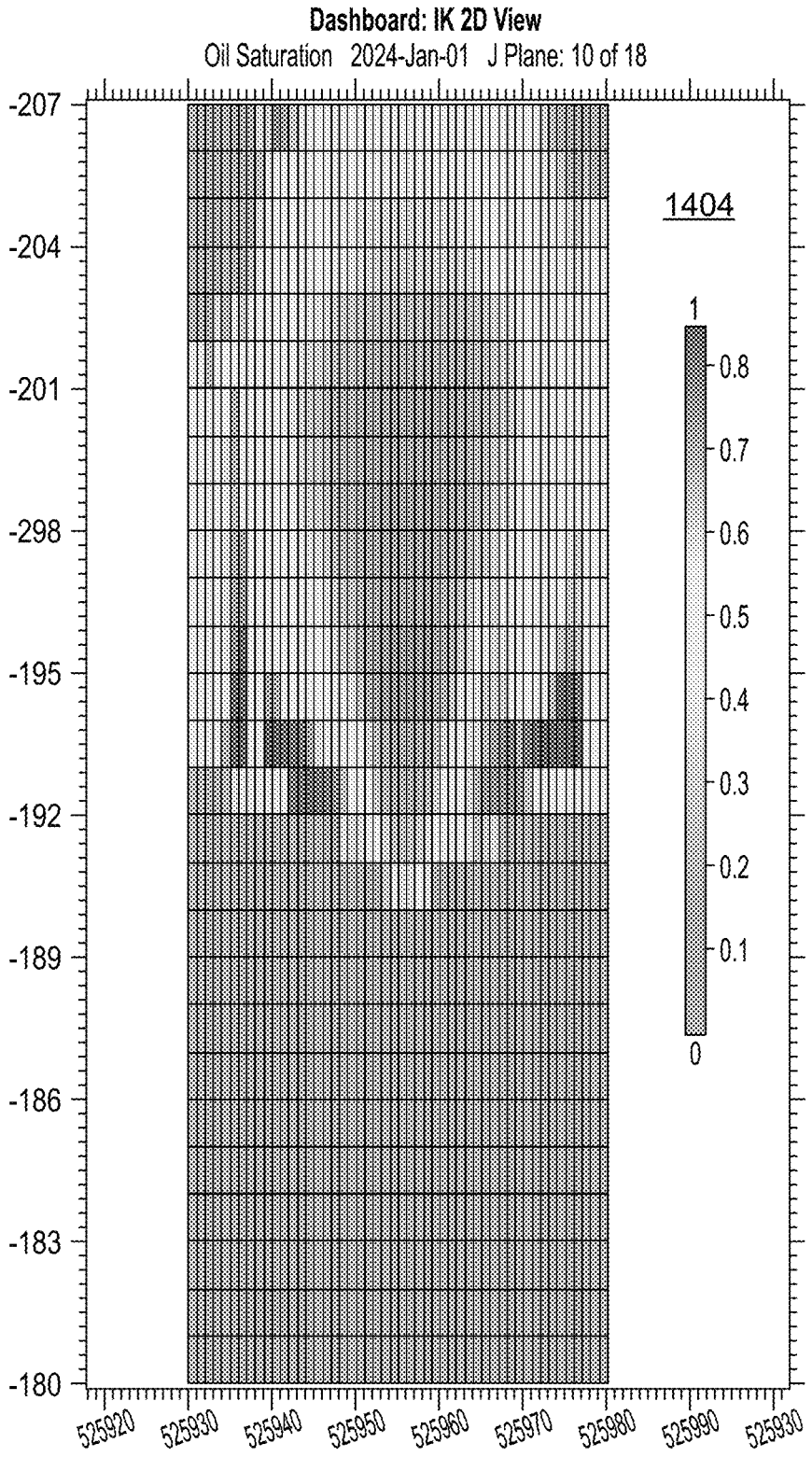
Figure 14C:
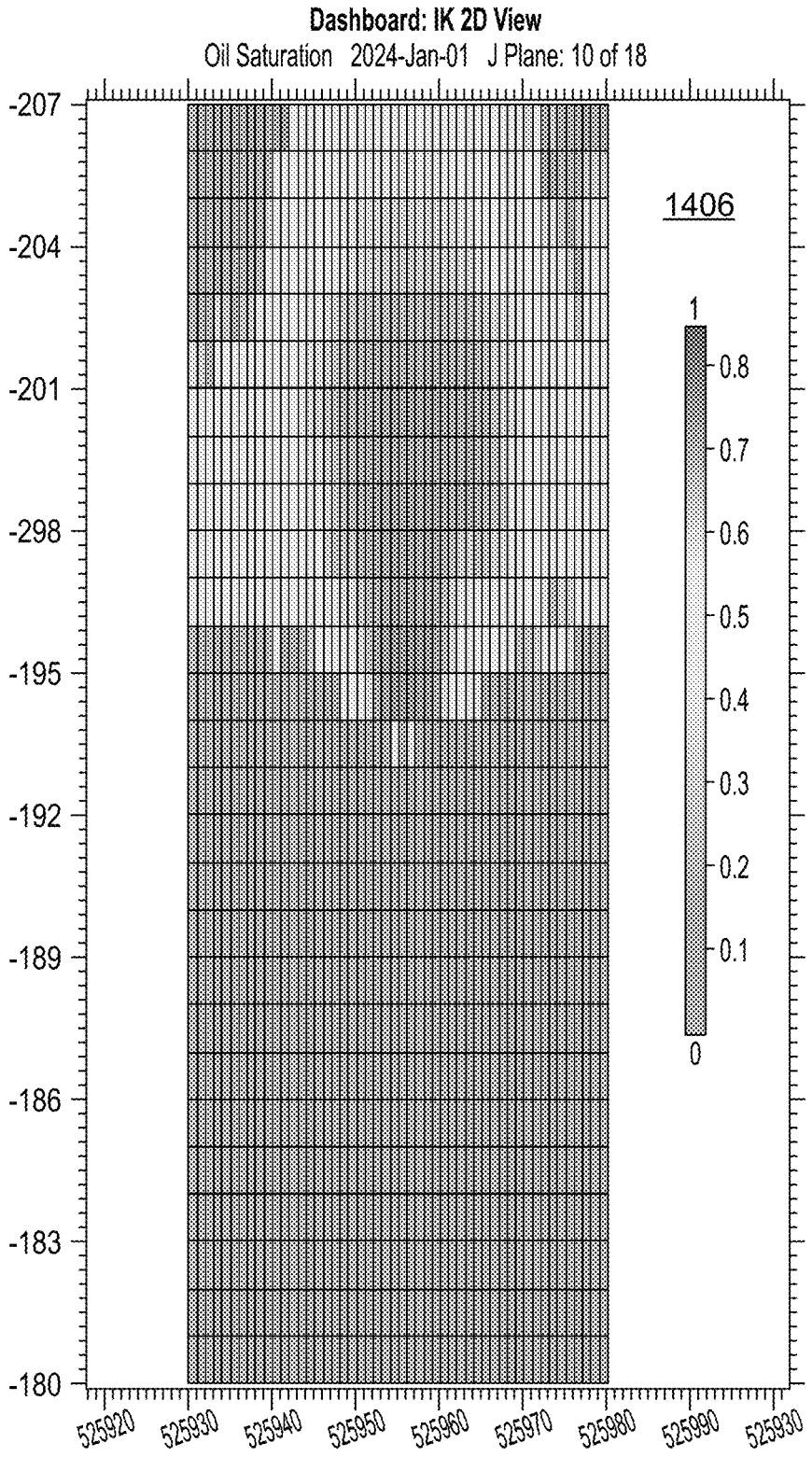

FIGS. 13A, 13B and 13C show the gas saturations of the wells in the JK plane (37 of 50). In FIGS. 13A, 13B and 13C FIC. 13, the panel for the conventional completion is identified by reference number 1302, the panel for the ICD-based completion is identified by reference number 1304, and the panel for the UPP-based completion is identified by reference number 1306. FIGS. 14A, 14B and 14C show the gas saturations of the wells in the IK plane (10 of 18). In FIGS. 14A, 14B and 14C, the panel for the conventional completion is identified by reference number 1402, the panel for the ICD-based completion is identified by reference number 1404, and the panel for the UPP-based completion is identified by reference number 1406. Both views clearly show that gas production has been reduced in the reservoir that uses ICDs. Likewise, both views clearly show that gas production has been reduced. This simulation highlights the potential for the methods of the present disclosure to have positive effects on gas production.

In the present disclosure, all terms referred to in singular form are meant to encompass plural forms of the same. Likewise, all terms referred to in plural form are meant to encompass singular forms of the same. Unless defined otherwise, all technical and scientific terms used herein have the same meaning as commonly understood by one of ordinary skill in the art to which this disclosure pertains.

As used herein, the term "about" refers to an approximately +/−10% variation from a given value. It is to be understood that such a variation is always included in any given value provided herein, whether or not it is specifically referred to.

It should be understood that the compositions and methods are described in terms of "comprising," "containing," or "including" various components or steps, the compositions and methods can also "consist essentially of or "consist of the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Although individual embodiments are discussed, the disclosure covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

Many obvious variations of the embodiments set out herein will suggest themselves to those skilled in the art in light of the present disclosure. Such obvious variations are within the full intended scope of the appended claims.

The invention claimed is:

1. A method for producing hydrocarbons from a subterranean reservoir that is penetrated by an injection well and a production well, wherein the production well comprises a substantially-horizontal section along which a plurality of individually-actuatable fluid-inlet components are spaced apart to define a plurality of production-well fluid-inlet zones in hydraulic communication with the horizontal section of the production well, the method comprising:

i) injecting an injection fluid comprising a solvent into the reservoir, by way of the injection well, to mobilize hydrocarbons in the reservoir, such that a drainage fluid comprising a liquid phase and a gas phase occupies one or more of the production-well fluid-inlet zones, wherein the gas phase comprises at least a portion of the solvent and the liquid phase comprises mobilized hydrocarbons;

ii) producing a production fluid at a production-flow rate via a pump running at a pump speed and in hydraulic communication with the production fluid, wherein the production fluid comprises at least a portion of the liquid phase of the drainage fluid and at least a portion of the gas phase of the drainage fluid such that the production fluid is defined by a liquid phase:gas phase ratio;

iii) during the producing of the production fluid of ii), identifying at least one of the production-well fluid-inlet zones as having a gas content above a threshold and thus being a higher-gas zone by distributed measurements of temperature or acoustic energy along the production well or by evaluation of flow performed autonomously by the fluid inlet components themselves during the producing of the production fluid; and iv) during the producing of the production fluid of ii), selectively actuating at least one of the plurality of fluid-inlet components based on the at least one of the plurality of fluid-inlet components being adjacent and corresponding to the higher-gas zone as determined in iii), in order to reduce flow of the drainage fluid through only the at least one of the fluid-inlet components corresponding to the higher-gas zone and thereby increase the liquid phase:gas phase ratio of the production fluid by prioritizing hydraulic communication with the rest of the plurality of production-well fluid-inflow zones spaced apart from the higher-gas zone, and orchestrating variations in the pump speed to modulate the production-flow rate and account for the variations in one or more of the plurality of fluid-inlet components.

2. The method of claim 1, wherein the plurality of fluid-inlet components comprises one or more inflow-control devices.

3. The method of claim 2, wherein the one or more inflow-control devices comprise shiftable ports that are configured for remote operation.

4. The method of claim 3, wherein the shiftable ports are actuated in response to changes in distributed acoustic sensing (DAS), distributed temperature sensing (DTS), or a combination thereof.

5. The method of claim 3, wherein the shiftable ports are actuated in response to changes in the liquid phase:gas phase ratio of the production fluid.

6. The method of claim 2, wherein the one or more inflow-control devices are autonomous inflow-control devices.

7. The method of claim 1, wherein the plurality of fluid-inlet components comprises one or more upper production ports.

8. The method of claim 7, wherein one or more of the plurality of fluid-inlet components are coupled to a production-string tubing that is in hydraulic communication with the pump.

9. The method of claim 1, wherein the plurality of fluid-inlet components are spaced apart by between about 50 m and about 500 m along the substantially-horizontal section of the production well.

10. The method of claim 1, wherein one or more of the fluid-inlet components are interposed between annulus-flow restrictors.

11. The method of claim 10, wherein the annulus-flow restrictors comprise packers.

12. The method of claim 1, wherein orchestrating variations in the pump speed of iv) comprises adjusting parameters such that the average gas-production rate is between:

(i) about 1,000 $m^3$/day and about 30,000 $m^3$/day under STP conditions, (ii) about 10,000 $m^3$/day and about 30,000 $m^3$/day under STP conditions, or (iii) about 20,000 $m^3$/day and about 30,000 $m^3$/day under STP conditions.

13. The method of claim 1, wherein the liquid phase:gas phase ratio of the production fluid is between: (i) about 1:100 and about 1:1, (ii) about 1:80 and about 1:20, or (iii) about 1:60 and about 1:40.

14. The method of claim 1, wherein at least one of the plurality of production-well fluid inlet zones has a temperature of between: (i) about 50° C. and about 300° C., (ii) about 70° C. and about 250° C., or (iii) about 120° C. and about 200° C.

15. The method of claim 1, wherein at least one of the plurality of production-well fluid-inlet zones has a pressure of between: (i) about 500 kPaA and about 10,000 kPaA, (ii) about 1,000 kPaA and about 8,000 kPaA, or (iii) about 3,000 kPaA and about 6,000 kPaA.

16. The method of claim 1, wherein the injection fluid further comprises steam.

17. The method of claim 16, wherein the injection fluid comprises less than about 50% solvent and greater than about 50% steam on a mass basis.

18. The method of claim 16, wherein the injection fluid comprises greater than about 50% solvent and less than about 50% steam on a mass basis.

19. The method of claim 1, wherein the solvent comprises propane, butane, diluent, natural gas condensate, or a combination thereof.

20. The method of claim 1, wherein the subterranean reservoir is a thin pay reservoir having an average height of between about 5 m and about 15 m.

* * * * *